US006780074B2

(12) United States Patent
Ouchi

(10) Patent No.: US 6,780,074 B2
(45) Date of Patent: Aug. 24, 2004

(54) METHOD FOR MANUFACTURING AN IMAGE DISPLAY DEVICE

(75) Inventor: Toshimichi Ouchi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 499 days.

(21) Appl. No.: 09/797,570

(22) Filed: Mar. 5, 2001

(65) Prior Publication Data

US 2002/0009944 A1 Jan. 24, 2002

(30) Foreign Application Priority Data

Mar. 6, 2000 (JP) ..... 2000/061127
Feb. 23, 2001 (JP) ..... 2001/048989

(51) Int. Cl.[7] ..... H01J 9/24
(52) U.S. Cl. ..... 445/24; 438/34
(58) Field of Search ..... 445/24, 25, 50, 445/51; 438/34

(56) References Cited

U.S. PATENT DOCUMENTS

| | | | |
|---|---|---|---|
| 5,622,634 A | 4/1997 | Noma et al. | 216/40 |
| 6,019,453 A | 2/2000 | Tsuruoka | 347/40 |
| 6,169,356 B1 | 1/2001 | Ohnishi et al. | 313/495 |
| 2001/0036682 A1 * | 11/2001 | Takeda et al. | 438/34 |

FOREIGN PATENT DOCUMENTS

| | | |
|---|---|---|
| EP | 0 908 916 A1 | 4/1999 |
| JP | 7-235255 | 9/1995 |
| JP | 8-171849 | 7/1996 |
| JP | 11-195374 | 7/1999 |
| JP | 2000-311594 | 11/2000 |

* cited by examiner

*Primary Examiner*—Joseph Williams
(74) *Attorney, Agent, or Firm*—Fitzpatrick, Cella, Harper & Scinto

(57) ABSTRACT

A method for manufacturing an image display device includes disposing the first substrate, on which conductors and wires connected to the conductors are formed, on a supporting member and covering a part of the first substrate with a container to thereby dispose the conductors within a space formed between the first substrate and the container. Part of the wires is disposed outside of the space. The method also includes the steps of providing the space with a desired atmosphere, applying a voltage to the conductors through the part of the wires disposed outside of the space, and connecting a second substrate including an image arming member via a connecting member to the first substrate, at a region of the first substrate different from a region where the container and the first substrate are connected together.

19 Claims, 15 Drawing Sheets

METHOD FOR MANUFACTURING AN IMAGE DISPLAY DEVICE

BACKGROUND OF THE INVENTION

1. Field of the Invention

The present invention relates to a method for manufacturing an image display device.

2. Description of the Related Art Conventional electron emitting devices are generally classified into two types of devices, i.e., thermionic cathode type devices and cold cathode type devices. The cold cathode type devices include field emission type devices, metal/insulating-layer/metal type devices, surface conduction type devices and the like.

The surface conduction type electron emitting devices utilize the phenomenon that electron emission occurs by passing a current in a direction parallel to the surface of a small-area thin film formed on a substrate. The assignee of the present application has provided a large number of proposals with respect to surface conduction type electron emitting devices having new configurations and applications thereof. The basic configurations and manufacturing methods of such devices are disclosed, for example, in Japanese Patent Application Laid-Open (Kokai) Nos. 7-235255 (1995), 8-171849 (1996), 2000-311594 (2000) and 11-195374 (1999), and EP-A No. 0908916.

The surface conduction type electron emitting devices have the feature that a pair of electrodes facing each other, and a conductive film connected to the pair of electrodes and having a gap in a part of the film are provided on a substrate.

A carbon film having at least one of carbon and a carbon compound as a main component is provided in the gap.

By providing a plurality of such electron emitting devices on a substrate and connecting the devices by wires, an electron source including a plurality of surface conduction type electron emitting devices can be manufactured.

By combining the electron source with a phosphor, an image display device can be formed.

Conventionally, such an electron source and an image display device are manufactured in the following manner.

In a first manufacturing method, first, a plurality of units, each including a conductive film and a pair of electrodes connected thereto, and wires connected to the electrodes are each formed on a substrate. Then, the entirety of the formed units on the substrate is placed in a vacuum chamber. After evacuating the vacuum chamber, a gap is formed in the conductive film of each of the units by applying a voltage to the unit through external terminals (a "forming" process). Then, a gag of a carbon compound is introduced into the vacuum chamber, and a voltage is again applied to each of the units in this atmosphere through the external terminals. By this voltage application, a carbon film having at least one of carbon and the carbon compound as a main component is formed in a portion including the gap (an "activating" process). As a result, an electron source is formed having the substrate and the plurality of electron emitting devices. Then, the panel of an image display device is manufactured by connecting the electron source and a substrate on which a phosphor is disposed, with an interval of a few millimeters provided between those components.

In a second manufacturing method, first, a plurality of units, each including a conductive film and a pair of electrodes connected thereto, and wires connected to the electrodes of the plurality of units are each formed on a substrate. Then, the panel of an image display device is manufactured by connecting the formed substrate and a substrate on which a phosphor is disposed, with an interval of a few millimeters being provided between them. Then, the inside of the panel is evacuated through an exhaust tube connected to the panel. Then, a gap is formed in the conductive film of each of the units by applying a voltage to the unit through external terminals of the panel (the "forming" process). Then, a gas of a carbon compound is introduced into the panel through the exhaust tube, and a voltage is again applied to each of the units in this atmosphere through the external terminals. By this voltage application, a carbon film having at least one of carbon and the carbon is compound as a main component is formed in a portion including the gap (the "activating" process). As a result, an electron source is provided having a plurality of electron emitting devices formed on a substrate.

SUMMARY OF THE INVENTION

In the conventional methods for manufacturing en electron source and an image display device, the above-described "forming" and "activating" processes are adopted. However, in the above-described first manufacturing method, as the size of the electron-source substrate is larger, a larger vacuum chamber and an evacuation apparatus having a larger pumping speed are required. In the second manufacturing method, a long time is required for both evacuation of a small space within the panel in the "forming" process, and uniform introduction of the gas used in the "activating" process into the panel and the succeeding evacuation of the gas.

It is an object of the present invention to provide a method for manufacturing an electron source and an image display device in which the speed of the "activating" process is increased and the uniformity of electron emission characteristics is improved, and which is suitable for mass production.

It is another object of the present invention to provide an image display device and a method for manufacturing the same in which an electron source having excellent electron emission characteristics can be manufactured, and wherein stable vacuum tightness is maintained by a substrate having an electron source formed thereon and a substrate having a phosphor formed thereon, disposed so as to face the first substrate.

The inventor of the present invention has discovered the following novel aspects of the invention as a result of keen investigations.

According to one aspect, the present invention which achieves these objectives relates to a method for manufacturing an image display device. The method includes the steps of disposing a first substrate on a supporting member, the first substrate having conductors and wires connected to the conductors mounted thereon, and covering a part of the first substrate with a container to thereby dispose the conductors within a space formed between the first substrate and the container. Part of the wires is disposed outside of the space. The method also includes the steps of providing the space formed between the container and the first substrate with a desired atmosphere, applying a voltage to the conductors through the part of the wires disposed outside of the space, removing the container from the first substrate, and connecting a second substrate including an image forming member via a connecting member, to a region of the first substrate different from a region where the container and the first substrate were connected together.

According to another aspect, the present invention which achieves these objectives relates to another method for manufacturing an image display device. The method includes a step of disposing a first substrate on a supporting member, the first substrate having mounted thereon a plurality of units and wires connecting the plurality of units. Each unit includes a pair of electrodes and a conductive film disposed between the pair of electrodes. A next step includes covering a part of the first substrate with the container, and thereby disposing the plurality of units within a space formed between the first substrate and the container. Part of the wires is disposed outside of the space. The method also includes the steps of providing the space formed between the container and the first substrate with a desired atmosphere, converting each of the plurality of units to an electron emitting device by applying a voltage to the plurality of units through the part of the wires disposed outside of the space, removing the container from the first substrate, and connecting a second substrate including an image forming member to the first substrate, via connecting member, at a region different from a region where the container and the first substrate were connected together.

According to still another aspect, the present invention which achieves these objectives relates to a further method for manufacturing an image display device. The method includes a step of disposing a first substrate on a supporting member, the first substrate having mounted thereon a plurality of units, a plurality of x-direction wires and a plurality of y-direction wires connected to the plurality of units. Each unit includes a pair of electrodes and a conductive film disposed between the pair of electrodes. A next step includes covering a part of the first substrate with the container, and thereby disposing the plurality of units within a space formed between the first substrate and the container. Part of the plurality of x-direction wires and the plurality of y-direction wires is disposed outside of the space. The method also includes the steps of providing the space formed between the container and the first substrate with a desired atmosphere, converting each of the plurality of units into an electron emitting device by applying a voltage to the plurality of units through the part of the plurality of x-direction wires and the plurality of y-direction wires disposed outside of the space, removing the container from the first substrate, and connecting a second substrate including an image forming member to the first substrate via a connecting member, at a region of the first substrate different from a region where the container and the first substrate were connected together.

An apparatus for manufacturing an electron-source substrate and an image display device according to the present invention includes a supporting member for supporting a substrate on which conductors are formed, and a container covering the substrate supported by the supporting member.

The container covers a part of the surface of the substrate, and can thereby form an airtight space on the substrate in a state in which part of wires formed on the substrate in a state of being connected to the conductors is exposed outside the container. An inlet and an outlet for a gas are provided at the container. Means for guiding the gas into the container and means for exhausting the gas from the container are connected to the inlet and the outlet, respectively. It is thereby possible to set the inside of the container to a desired atmosphere. An electron source is formed by the substrate and electron emitting portions formed thereon according to electric processing.

Accordingly, the above-described manufacturing apparatus also includes means for performing electric processing, such as means for applying a voltage to the conductors. In this manufacturing apparatus, it is possible to reduce the size of the apparatus, achieve a simple operability, for example, in electric connection to a power supply in the electric processing, increase the degree of freedom in the design of the size, the shape and the like of the container, and perform introduction of the gas into the container and exhaust of the gas to the outside of the container in a short time.

In the manufacturing method, first, the substrate on which the conductors and the wires connected to the conductors are formed is disposed on the supporting member, and the conductors on the substrate are covered with the container except for part of the wires. Thus, the conductors are disposed in the airtight space formed on the substrate in a state in which part of the wires formed on the substrate is exposed outside of the container.

Then, the inside of the container is set to a desired atmosphere, and electric processing is performed by, for example, application of a voltage to the conductors through the part of the wires exposed outside of the container. The desired atmosphere is, for example, a low-pressure atmosphere, or an atmosphere in which a specific gas is present. The electric processing causes the electron source to be formed by forming the electron emitting portions (which partially include the conductors). The electric processing may be performed a plurality of times in different atmospheres, depending on applicable design criteria.

For example, the conductors on the substrate are covered by the container except for part of the wires. First, the step of providing the inside of the container with a first atmosphere is performed. Then, the step of providing the inside of the container with a second atmosphere is performed. Thus, as a result, an electron source is manufactured by forming electron emitting portions in the conductors.

The first atmosphere preferably is a low-pressure atmosphere, and the second atmosphere preferably is an atmosphere in which a specific gas, such as a carbon compound or the like, is present.

In the above-described manufacturing method, it is possible to easily perform electric connection to the power supply in the electric processing since part of the wires connected to the conductors is disposed outside of the container. Since the degree of freedom in the design of the size, the shape and the like of the container is increased, it is possible to perform introduction of the gas into the container and exhaust of the gas to the outside of the container in a short time, improve the manufacturing speed, and improve the reproducibility of the electron emission characteristics of the manufactured electron source, particularly, uniformity in the electron emission characteristics of the plurality of electron emitting portions.

The electron-source substrate manufactured in the above-described manner and another substrate having a phosphor formed thereon are connected via a frame member using frit glass or the like so as to maintain a constant interval between the two substrates. Preferably, the region of the electron-source substrate where the other substrate contacts the electron-source substrate is different from the region where the container contacted the electron-source substrate. Accordingly, the connection between the electron-source substrate and the other substrate having the phosphor formed thereon via the frame member is not influenced by adhesion of components of a vacuum-tight member provided in the container when connected to the electron-source substrate, and a stable connection and reliable provision of a vacuum can be realized.

DETAILED DESCRIPTION OF THE PREFERRED EMBODIMENTS

Figure 1A:
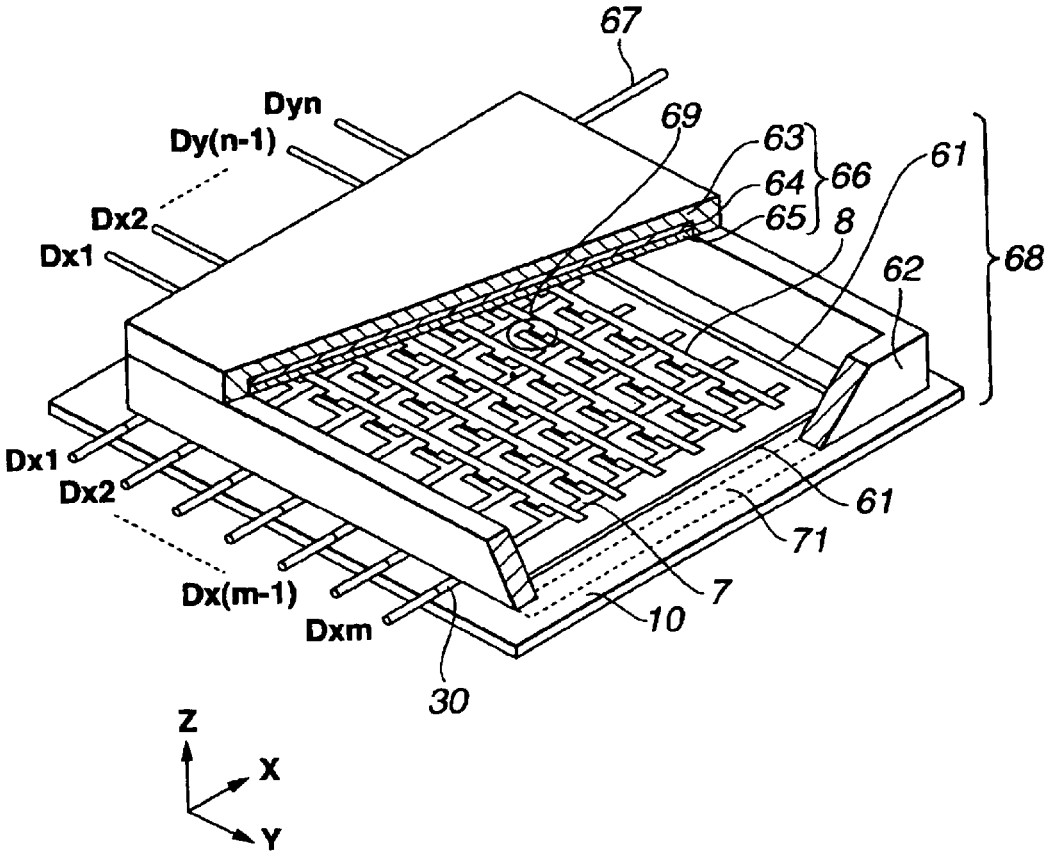
FIG. 1A is a schematic perspective view illustrating the configuration of an image forming apparatus with an upper portion of the apparatus shown as being partially removed.
Figure 1B:
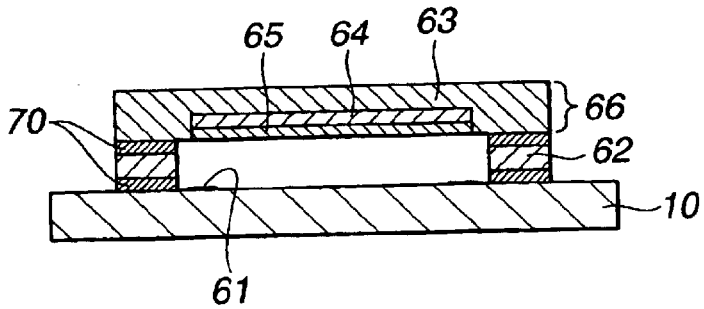
FIG. 1B is a cross-sectional view of the image forming apparatus shown in FIG. 1A.
Figure 2:
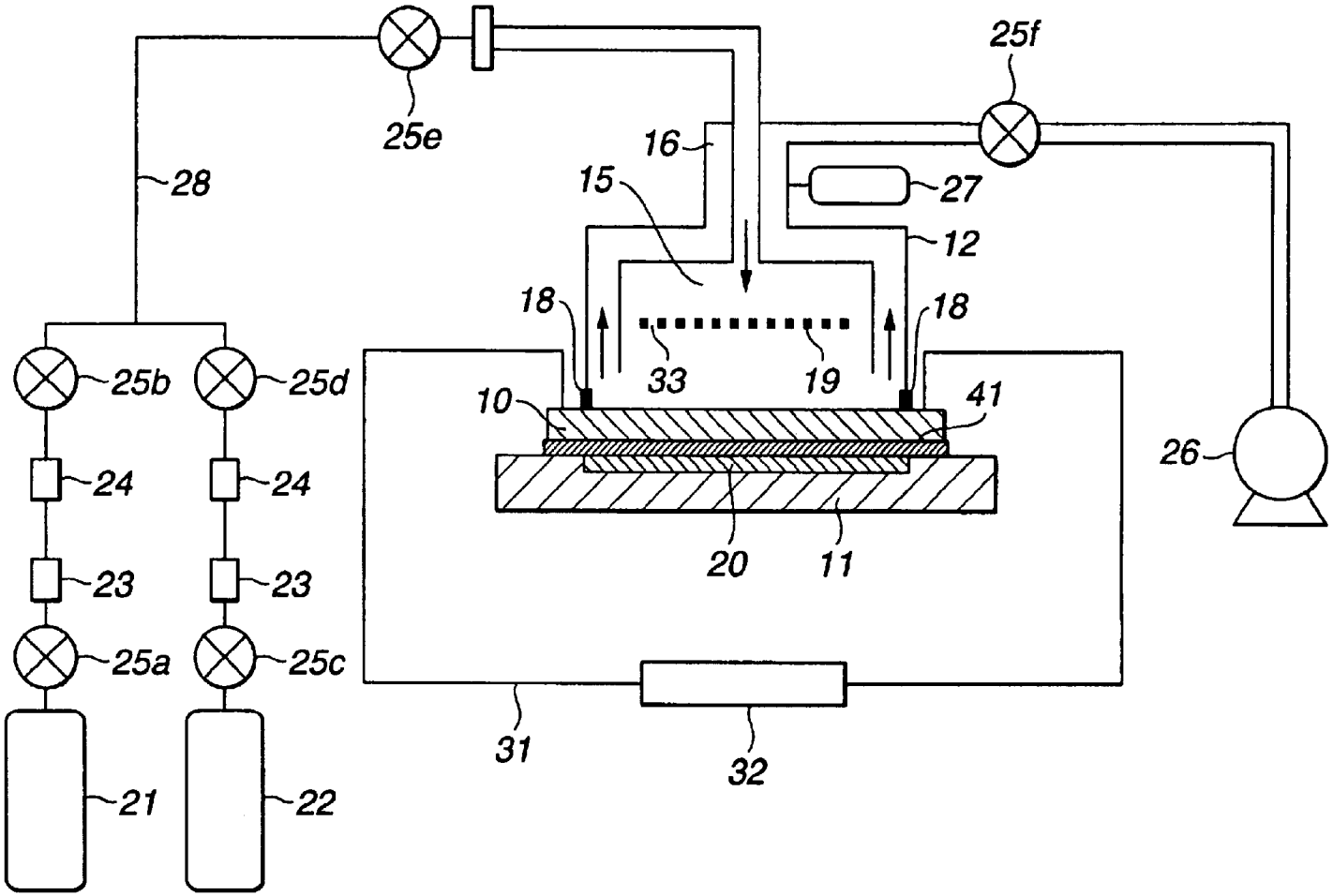
FIG. 2 is a cross-sectional view illustrating the configuration of an apparatus for manufacturing an electron source according to the present invention.
Figure 3:
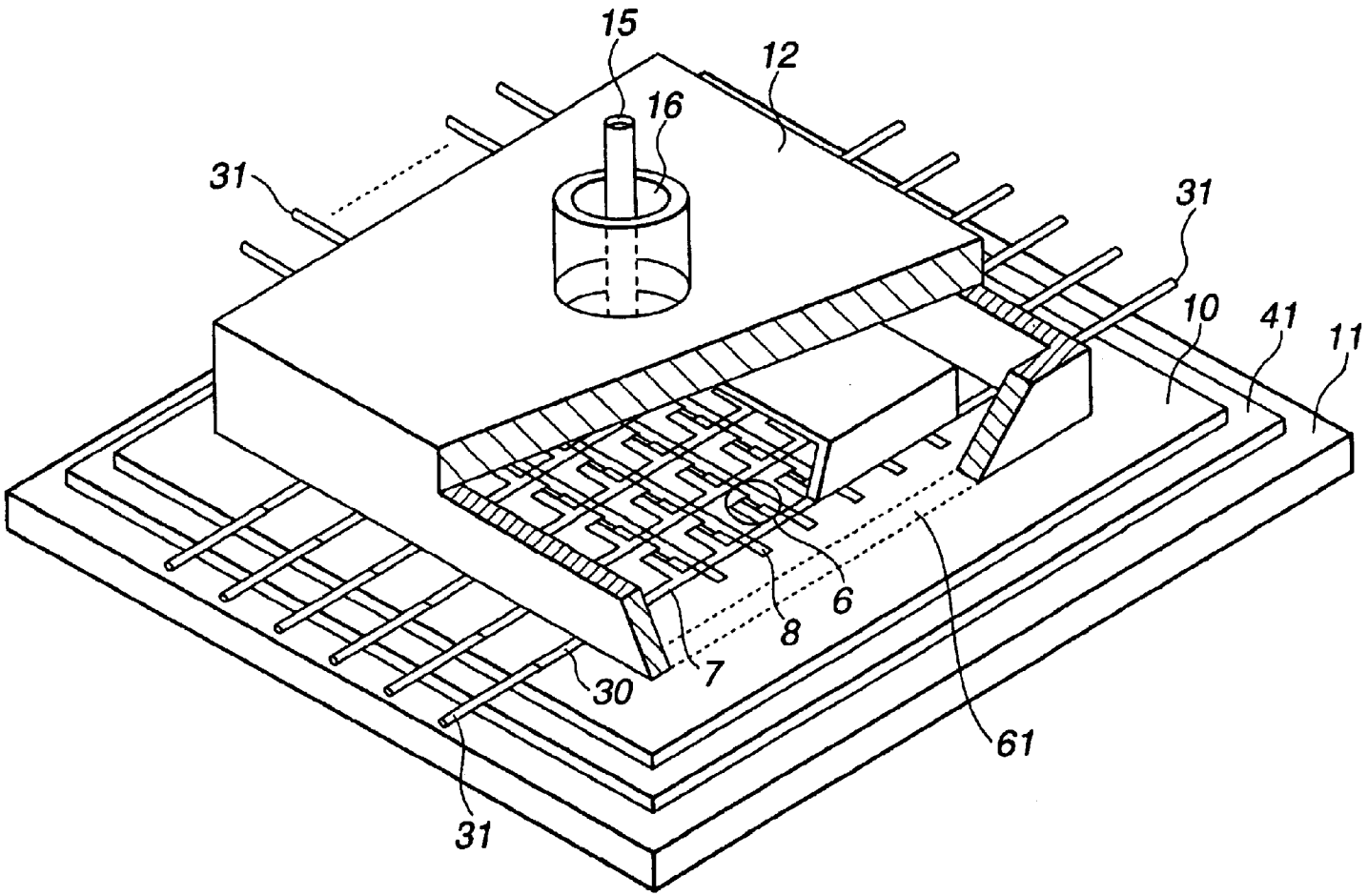
FIG. 3 is a perspective view illustrating a surrounding portion of an electron-source substrate shown in FIGS. 2 and 4 with a portion of that surrounding portion shown removed.
Figure 4:
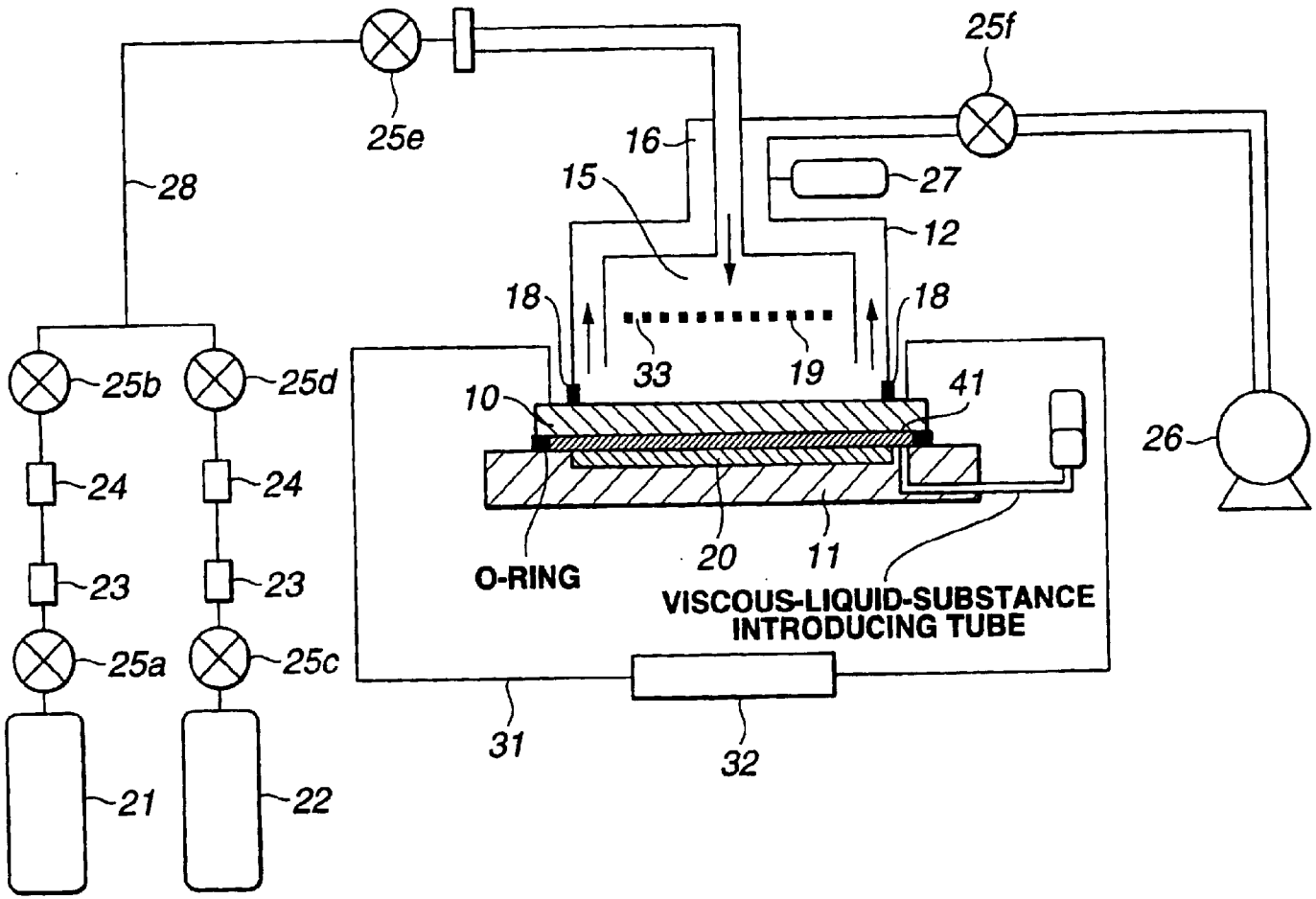
FIG. 4 is a cross-sectional view illustrating the configuration of another apparatus for manufacturing an electron source according to the present invention.

A description will now be provided of a method for manufacturing an image display device and a method for manufacturing an electron source according to the present invention with reference to schematic diagrams shown in FIGS. 1A, 1B, 2, 3 and 4. FIG. 1A is a schematic perspective view of an image display device manufactured according to the manufacturing method of the present invention. In FIG. 1A, part of a face plate 66 and part of a supporting frame 62 are omitted for ease of display. FIG. 1B is a schematic cross-sectional view taken along the x-z plane, illustrating the image display device shown in FIG. 1A. FIGS. 2, 3 and 4 are schematic diagrams illustrating an apparatus for manufacturing an electron source (an electron-source substrate). FIGS. 2 and 4 are cross-sectional views of the electron-source manufacturing apparatus, and FIG. 3 is an enlarged perspective view of a surrounding portion of a vacuum container 12. In FIGS. 1A, 1B, 2, 3 and 4, a member provided with the same reference numeral is the same member.

The electron-source manufacturing apparatus is used at least in the above-described "activating" process, and is preferably also used in the above-described "forming" process.

In FIGS. 1A, 1B, 2, 3 and 4, there are shown x-direction wires 7, y-direction wires 8, electron emitting devices 69, a rear plate (an electron-source substrate) 10, a face plate 66 including a phosphor film 64 and a conductive film (a metal back) 65 formed on an inner surface of a transparent substrate 63, and a supporting frame 62 for providing a low-pressure space between the face plate 66 and the rear plate 10. A terminal 67 is used for applying a high voltage to the conductive film (metal back) 65. External connections Dx1–Dxm are connected to corresponding ends 30 of the x-direction wires 7, which extend from the space surrounded by the rear plate 10, the supporting frame 62 and the face plate 66, to outside of the frame 62, at portions outside of the low-pressure space. External connections Dy1–Dyn are connected to corresponding ends 30 of the y-direction wires 8, which extend from the space surrounded by the rear plate 10, the supporting frame 62 and the face plate 66, to outside of the frame 62, at portions outside of the low-pressure space.

Reference numeral 61 represents a connection region (also referred to herein as a "contact region") between the rear plate 10 and a vacuum container 12 (a vacuum-tight member 18) (FIG. 2) used in the "activating" process (to be described later). Reference numeral 71 represents a connection region (contact region) between the supporting frame 62 (connection members 70) (FIG. 1B) and the rear plate 10.

Figure 19A:
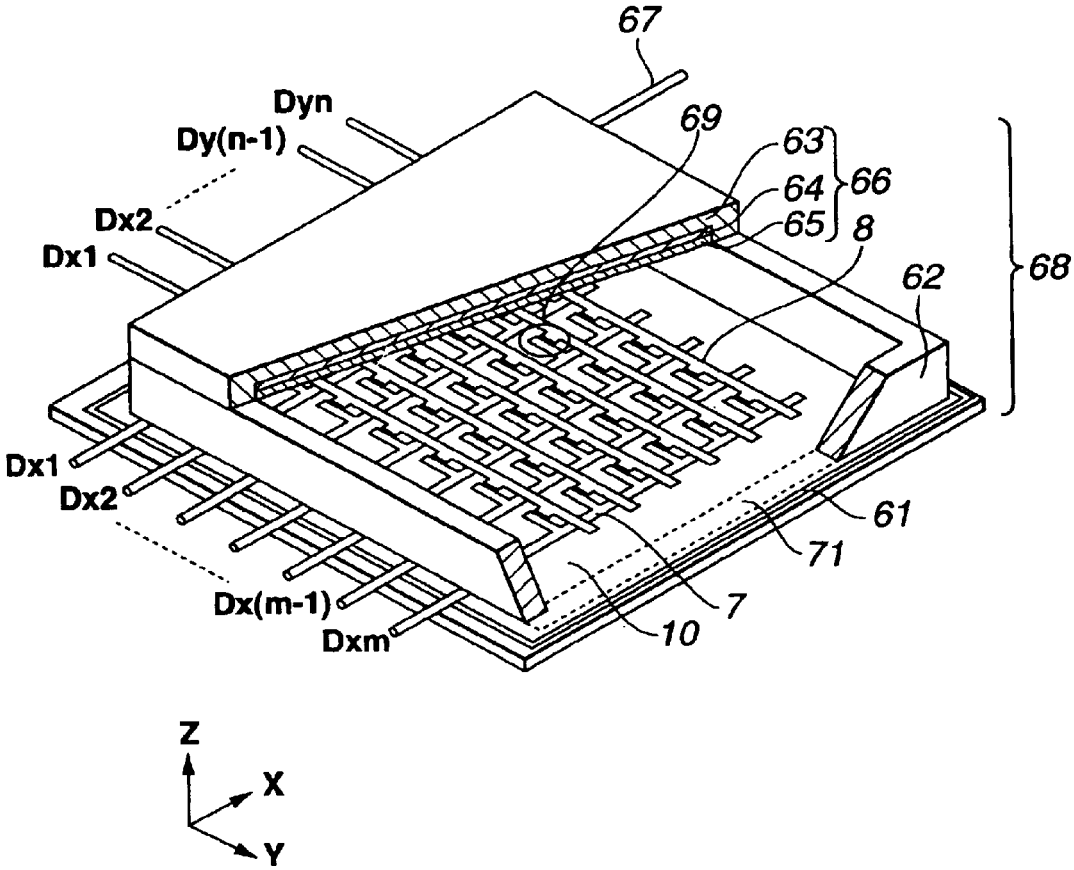
FIG. 19A is a schematic perspective view illustrating the configuration of an image forming apparatus with an upper portion of the apparatus shown as having been removed.
Figure 19B:
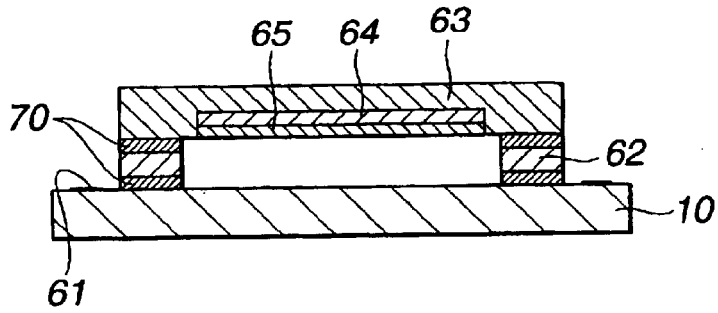
FIG. 19B is a cross-sectional view of the image forming apparatus shown in FIG. 19A.

In this case, the connection region 61 between the vacuum container 12 (the vacuum-tight member 18) (FIGS. 2 and 3) and the rear plate 10 is disposed adjacent to an inside boundary of the connection region 71 where the supporting frame 62 (the connection members 70) contacts the rear plate 10. However, as shown in FIG. 19A, a configuration of an image display device in which the connection region 61 in which the vacuum container 12 (the vacuum-tight member 18) contacts the rear plate 10 is disposed outside the connection region 71 (adjacent to an outer boundary of 71) in which the supporting frame 62 (the connection members 70) contacts the rear plate 10 may also be provided. FIG. 19B is a schematic cross-sectional view taken along the xz plane of the image display device shown in FIG. 19A.

That is, as will be described in detail later, the most important point of the manufacturing method of the present invention is that the connection region 61 in which the vacuum container 12 (the vacuum-tight member 18) connects to the rear plate 10 differs from the connection region 71 in which the supporting frame 62 (the connection members 70) connects to the rear plate 10. According to this configuration, it is possible to minimize a bad influence of the residue of the vacuum-tight member 18 (which is used in order to provide an airtight between the vacuum container 12 and the rear plate 10) remaining on the rear plate 10 after being connected between the rear plate 10 and the supporting frame 62. As a result, it is possible to provide an air-tight contact between the supporting frame 62 and the rear plate 10, and stably maintain a high vacuum within the image display device for a long time.

In FIG. 3, a unit 6 includes a pair of electrodes and a conductive film connecting the pair of electrodes. The unit 6 becomes an electron emitting device by being subjected to the "forming" process and the "activating" process which have been described above.

In FIGS. 1A, 1B, 2, 3 and 4, there are shown the x-direction wires: 7, the y-direction wires 8, the rear plate 10, a supporting member 11 for supporting the rear plate 10, the vacuum container (cover) 12, a gas inlet 15, and a gas outlet 16. The x-direction wires 7 and the y-direction wires 8 are connected to the units 6. The vacuum-tight member (hereinafter termed a "seal member") 18 is provided between the rear plate 10 and the vacuum container 12 in order to maintain a space surrounded by the rear plate 10 and the vacuum container 12 in an airtight state. Preferably, the seal member 18 is bonded to the vacuum container 12. The end portions 30 of the x-direction wires 7 and the y-direction wires 8 extend from the space surrounded by the rear plate 10 and the vacuum container 12 to the outside of the overall device. A driver 32 includes a power supply and a current control system. External wires 31 connect the end portions 30 of the x-direction wires 7 and the y-direction wires 8 (not shown in FIG. 2) to the driver 32.

There are also shown a diffusing plate 19, apertures 33 in the diffusing plate 19, temperature control means 20 for the rear plate 10, and a heat conducting member 41. Although the diffusing plate 19 is preferably provided so that a gas used for the "activation" process and/or a gas used for the "forming" process are uniformly supplied to the plurality of units 6, it is not always necessary to employ that device 19. Although the temperature control means 20 and the heat conducting member 41 are preferably used when the area (a region where the units 6 are provided) of the rear plate 10 is large, they are not always necessary as well.

When using the above-described manufacturing apparatus for the "forming" process, a reducing material (such as hydrogen or the like) for the conductive film 65 of the unit 6 is selected as a source gas 21. When using the electron-source manufacturing apparatus for the "activating" process, a carbon compound material is selected as the source gas 21.

Although a carrier gas 22 is used for the ease of introduction of the source gas 21 into the vacuum container 12 whenever necessary, it is not always necessary. Although filters 23 for removing water, gas flow controllers 24, valves 25*a*–25*f*, a vacuum pump 26, a vacuum gauge 27 and a tube 28 preferably are used whenever necessary, they are no always necessary in other embodiments.

The supporting member 11 holds and fixes the rear plate 10, and preferably has a mechanism for fixing the rear plate 10 by means of a vacuum chuck mechanism, a fixing jig or the like (not shown). The temperature control means 20, such as a heater or the like, is preferably incorporated within the supporting member 11, and can heat the rear plate 10 via heat conducting member 41 whenever necessary. The heat conducting member 41 preferably is provided on the supporting member 11. The heat conducting member 41 may be grasped between the supporting member 11 and the rear plate 10, or in other embodiments, no member 41 need be employed, as the supporting member 11 itself may have the function of the heat conducting member 41, so there is no obstacle to the holding and fixing of the rear plate 10.

A viscous liquid substance, such as silicone grease, silicone oil, a gel or the like, is preferably used as the heat conducting member 41. Such a deformable heat conducting member 41 can absorb warping and undulation of the rear plate 10, and assuredly transmit heat produced in a process of applying a voltage to the units 6 (the "forming" process or the "activating" process) to the supporting member 11 and a sub-vacuum container (to be described below) in order to radiate the heat, prevent the generation of crack or damage of the rear plate 10, and thereby contribute to improvement in the production yield.

When there is the problem that the heat conducting member 41 comprising a viscous liquid substance (not shown) moves over the supporting member 11, it is preferable to add a residence mechanism on the supporting member 11 in accordance with the region on the rear plate 10 where the units 6 are formed so that the viscous liquid substance resides at predetermined positions and regions, i.e., at least in the mentioned region. For example, an O-ring, or a heat-resisting bag containing the viscous liquid substance to provide a closed heat conducting member may be used as the residence mechanism.

When causing the viscous liquid substance to reside by providing an O-ring or the like, the viscous liquid substance sometimes insufficiently contacts the supporting member 11 due to an air layer formed between the viscous liquid substance and the supporting member 11 In order to prevent such a problem, it is preferable to adopt a configuration of providing threaded holes for passing air, or a method of injecting the viscous liquid substance between the supporting member 11 and the rear plate 10 after placing the rear plate 10. FIG. 4 is a schematic diagram illustrating an apparatus in which an O-ring and a viscous-liquid-substance introducing tube are provided so that the viscous liquid substance resides in a predetermined region.

Figure 9:
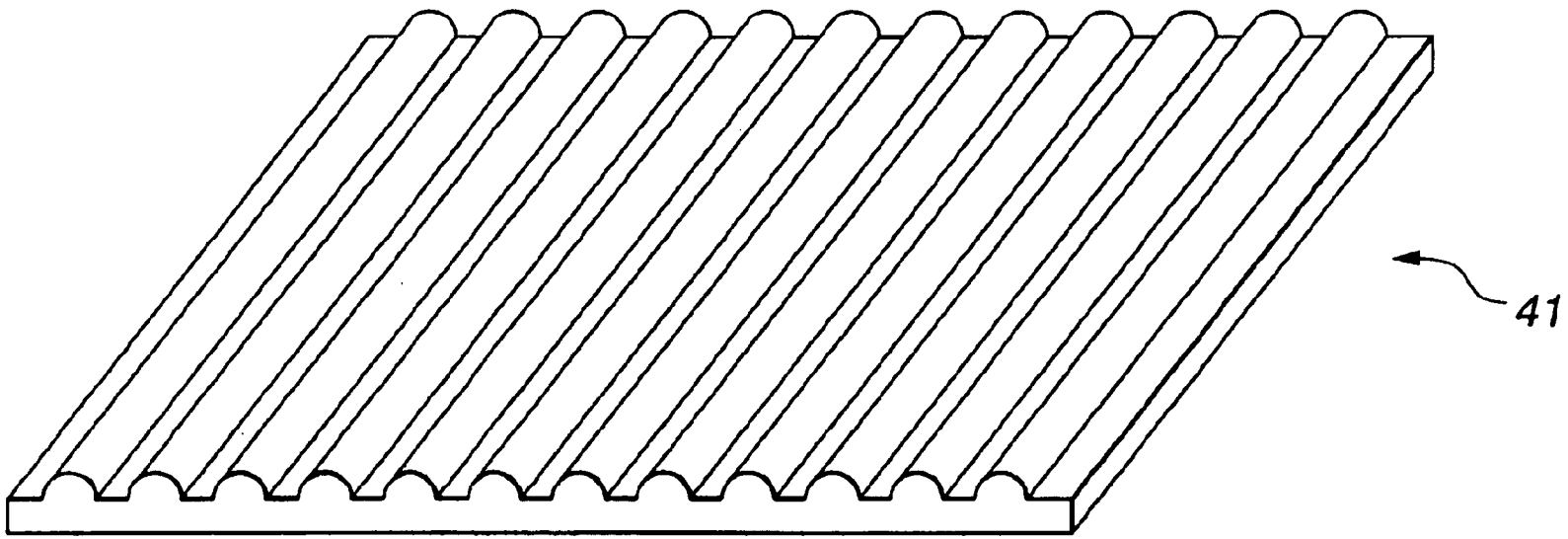
FIG. 9 is a perspective view illustrating the shape of a heat conducting member used in an apparatus for manufacturing an electron source according to the present invention.
Figure 10:
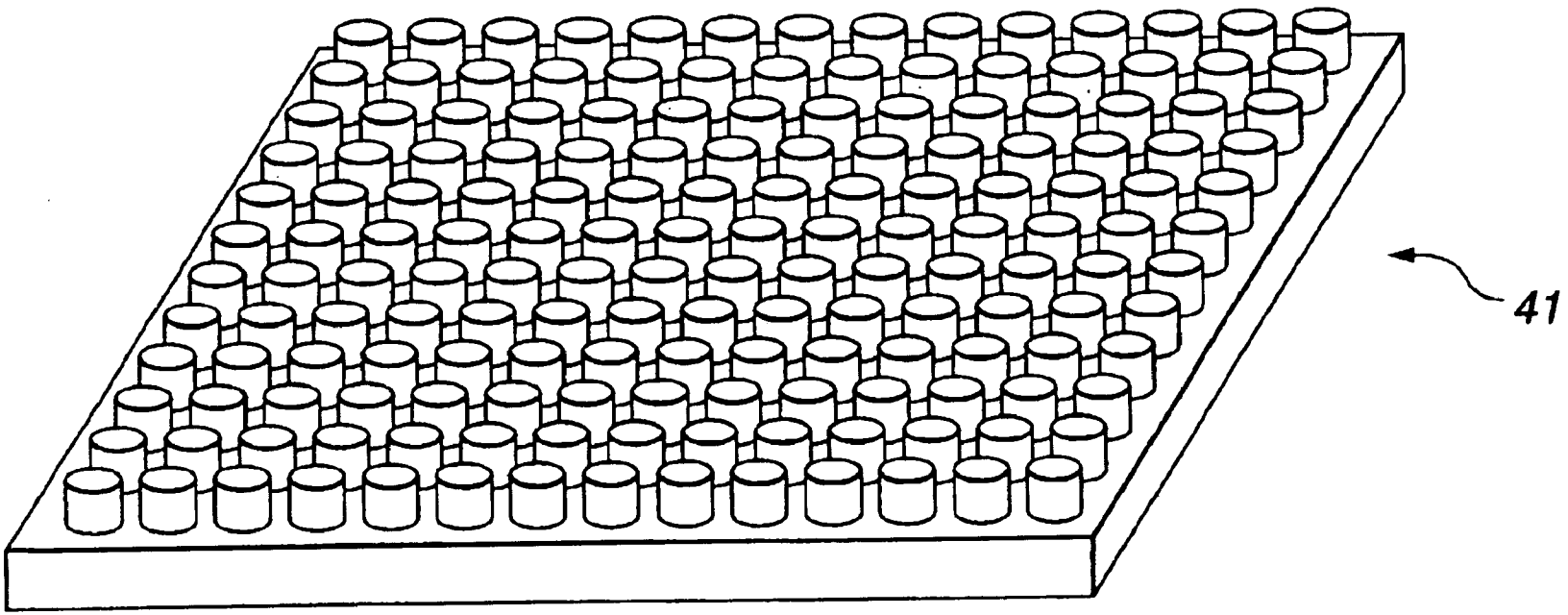
FIG. 10 is a perspective view illustrating the shape of another heat conduction member used in an apparatus for manufacturing an electron source according to the present invention.

The heat conducting member 41 may be an elastic member. For example, a synthetic resin, such as a Teflon resin or the like, a rubber material, such as silicone rubber or the like, a ceramic material, such as alumina or the like, or a metal material, such as copper, aluminum or the like, may be used as the material for the elastic member. Such a material may be used in the form of a sheet or a divided sheet. Alternatively, as shown in FIG. 9 or 10, pillars in the form of a cylinder, a prism or the like, projections in the form of a line, a cone or the like extending in the x direction or the y direction, adapted to the interconnections on the rear plate 10, round members in the form of a sphere, a rugby ball (an elliptical sphere) or the like, spherical members in which projections are formed on the surfaces of spheres, or the like may be provided as the member 41 on the supporting member 11.

Figure 11:
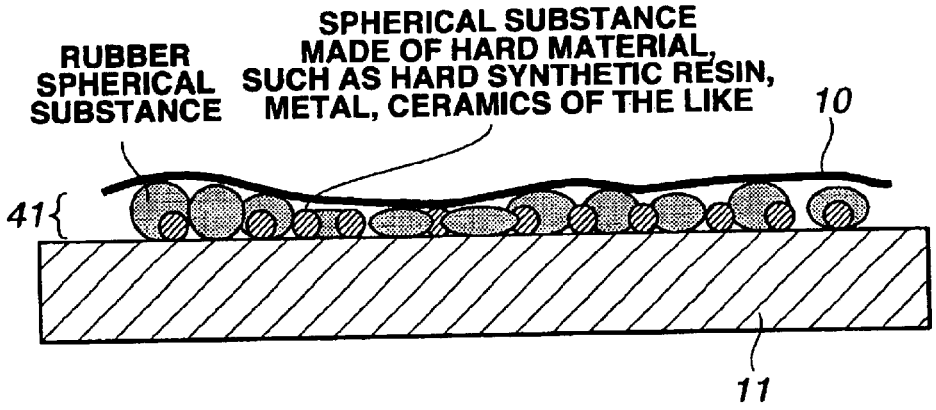
FIG. 11 is a cross-sectional view illustrating the configuration of a heat conducting member using a rubber spherical substance which is used in an apparatus for manufacturing an electron source according to the present invention.

FIG. 11 is a schematic diagram illustrating the configuration of a heat conducting member 41 using a plurality of spherical elastic members. The heat conducting member 41 is formed by dispersing and holding easily deformable fine spherical substances made of rubber or the like, and spherical substances having diameters smaller than the diameters of the fine spherical substances (which are less deformable than the rubber), between the electron-source substrate 10 and the supporting member 11.

Figure 12:
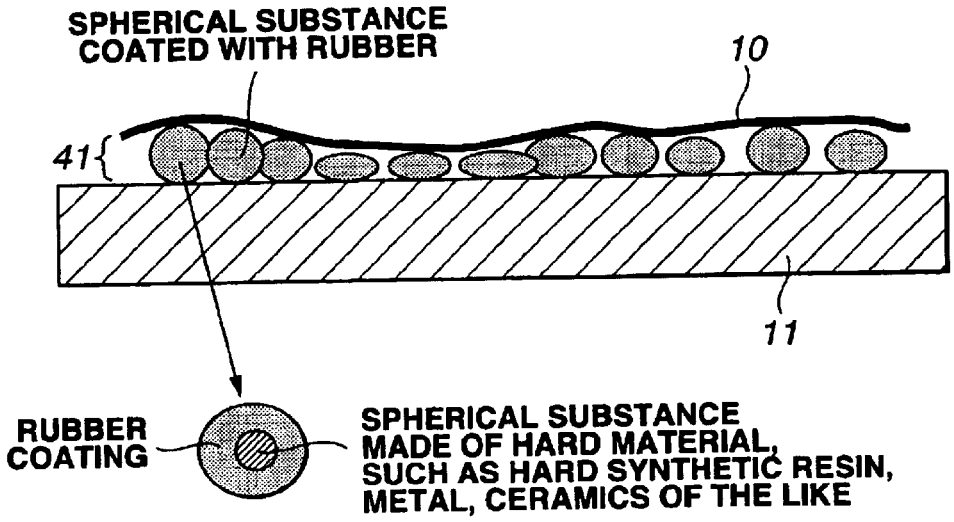
FIG. 12 is a cross-sectional view illustrating the configuration of another heat conducting member using a rubber spherical substance which is used in an apparatus for manufacturing an electron source according to the present invention.

FIG. 12 is a schematic diagram illustrating the configuration of a heat conducting member 41 made of a composite material. A spherical central member of the member 41 is formed by a hard material, such as a ceramic material, metal or the like. The heat conducting member 41 is provided by substances obtained by coating the surfaces of the spherical central members with rubber. When using, for example, spherical substances easily movable on the supporting member 11, a configuration in which a residence mechanism is provided on the supporting member 11 as described in the case of using a viscous liquid material is desirable.

Projections and recesses may be formed on the surface of an elastic heat conducting member 41 facing the electron-source substrate 10. The projections and recesses preferably have the above-described shape of pillars, lines, projections, spheres (semi-spheres) or the like. More specifically, linear projections and recesses substantially adapted to the x-direction or y-direction interconnections on the electron-source substrate 10, as shown in FIG. 9, or pillar projections substantially adapted to the positions of respective electrodes, as shown in FIG. 10, are preferable. Alternatively, although not illustrated, it is preferable that semispherical projections are formed on the surface of the heat conducting member 41.

By disposing the heat conducting member 41 in the above-described manner, it is possible to promptly and assuredly radiate heat in the process of applying a voltage to the respective units 6 (the "forming" process or the "activating" process). It also is possible to contribute to reduction of the density distribution of the introduced gas due to the temperature distribution, and reduction of non-uniformity of electron emitting devices due to the heat distribution of the substrate, and allow manufacture of a very uniform electron source.

For example, a closed tube (not shown) in which a temperature-control medium is sealed may be adopted as the temperature control means 20. Although not illustrated, a mechanism, in which the above-described viscous liquid substance is held between the supporting member 11 and the rear plate 10 and is circulated while performing temperature control, may be used as heating means or cooling means for the rear plate 10. Temperature control for a target temperature can also be performed. For example, a mechanism (not shown) including a circulating temperature control device, a liquid medium and the like may also be used.

The vacuum container (cover) 12 is made of glass or stainless steel. The vacuum container (cover) 12 covers the rear plate 10 so that a partial region (the end portions of the x-direction interconnections 7 and the y-direction interconnections 8) on the surface of the rear plate 10 is exposed to the atmospheric air. More specifically, as shown in FIG. 3, a region where the units 6 on the rear plate 10 are formed is contained in the space surrounded by the vacuum container 12 and the rear plate 10. On the other hand, in a region on the surface of the rear plate 10 which is not surrounded by the vacuum container 12 and the rear plate 10, the end portions of the x-direction interconnections 7 and the y-direction interconnections 8 are exposed to the atmospheric air. According to such a configuration, it is possible to easily perform application of a voltage to each of the units 6 in the "activating" process or the "forming" process via the end portions 30 of the interconnections 7 and 8 which are exposed to the atmospheric air.

The vacuum container 12 is preferably configured so as to be able to endure at least a pressure range between $1.33\times10^{-1}$ Pa ($1\times10^{-3}$ Torr) and the atmospheric pressure.

The seal member 18 (FIG. 2) is an elastic member used for maintaining air tightness between the rear plate 10 and the vacuum container 12. Preferably, the elastic member is made of rubber, and is embodied as an O-ring or a rubber sheet made of nitrile rubber, silicone rubber, fluororubber or the like.

An organic gas, or a gas obtained by diluting an organic gas by an inert gas, such as nitrogen, helium, argon or the like, is used as the carbon-compound gas used in the "activating" process.

When performing the "forming" process (to be described later), it is preferable to introduce a gas for accelerating formation of a gap in the conductive film, such as a gas for reducing the conductive film (preferably, a hydrogen gas or the like) 65, into the vacuum container 12.

An organic substance to be used in the "activating" process of the electron emitting device preferably is selected from aliphatic hydrocarbons, such as alkane, alkene, alkyne and the like, aromatic hydrocarbons, alcohols, aldehydes, ketones, amines, nitrites, phenol, organic acids, such as carboxylic acid, sulfonic acid and the like. More particularly, a saturated hydrocarbon represented by a composition formula of $C_nH_{2n+2}$, such as methane, ethane, propane or the like, an unsaturated hydrocarbon represented by a composition formula of $C_nH_{2n}$, such as ethylene, propylene or the like, benzene, toluene, methanol, ethanol, acetaldehyde, acetone, methyl ethyl ketone, methylamine, ethylamine, phenol, benzonitrile, acetonitrile or the like preferably may be used.

When the organic substance to be used is a gas at room temperature, the substance can be directly used. On the other hand, when the organic substance to be used is a liquid or a solid at room temperature, the substance preferably is used by being evaporated or sublimated within a container.

When using the above-described carrier gas 22, the organic gas 21 and the carrier gas 22 are mixed at a constant ratio, and the gas mixture is introduced into the vacuum container 12. The flow rate and the mixture ratio of the organic gas 21 and the carrier gas 22 are controlled by gas-flow controllers 24. The gas-flow controller 24 preferably includes a mass flow controller, an electromagnetic valve or the like. The gas mixture is heated to an appropriate temperature by a heater (not shown) provided around the tube 28 if necessary, and is then guided into the vacuum container 12 through the inlet 15. The heating temperature of the gas mixture preferably is substantially equal to the temperature of the electron-source substrate 10.

It is preferable to provide the water removing filters 23 at portions upstream from the tube 28 in order to remove water in the introduced gas. A moisture absorbent, such as silica gel, a molecular sieve, magnesium hydroxide or the like, may be used for the water removing filter 23.

The gas introduced into the vacuum container 12 is exhausted at a constant pumping speed by the vacuum pump 26 via the exhaust outlet 16, and the pressure of the gas mixture within the vacuum container 12 preferably is maintained to a constant level. The vacuum pump 26 used in the invention preferably is a rough vacuum pump, such as a dry pump, a diaphragm pump, a scroll pump or the like, although in a preferred embodiment an oil-free pump preferably is used.

Although it depends on the type of the organic substance to be used in the "activating" process, it is preferable to use a gas in a so-called viscous-flow region in order to more easily perform the "activating" process in this manufacturing apparatus. In the "viscous-flow region", the pressure has at least a value at which the mean free path $\lambda$ of the gas (the organic gas, or the gas mixture of the organic gas and the carrier gas) introduced into the vacuum container 12 is sufficiently smaller than the size of the inside of the vacuum container 12. More specifically, the pressure preferably is between several hundreds of Pa (several Torrs) and the atmospheric pressure.

Figure 13:
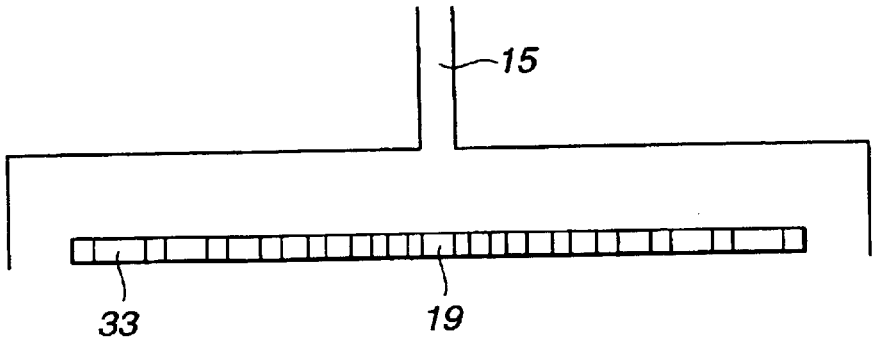
FIG. 13 is a cross-sectional view illustrating the shape of a diffusing plate used in an apparatus for manufacturing an electron source according to the present invention.
Figure 14:
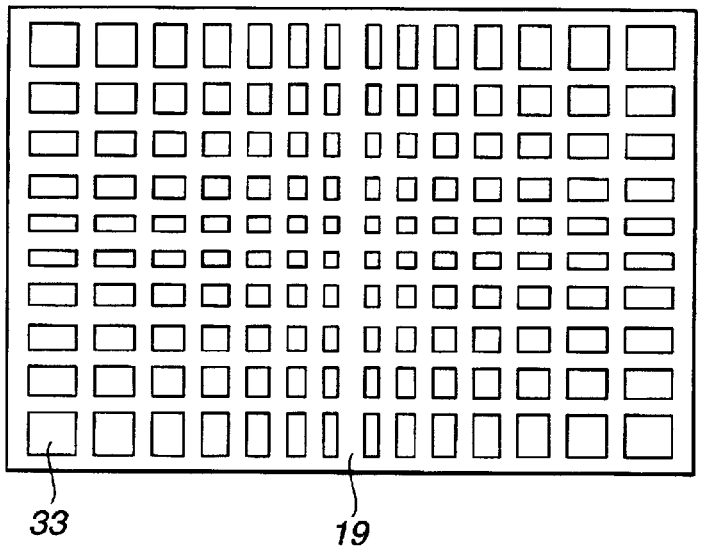
FIG. 14 is a cross-sectional view illustrating the shape of another diffusing plate used in an apparatus for manufacturing an electron source according to the present invention.

By providing the diffusing plate 19 between the gas inlet 15 of the vacuum container 12 and the electron-source substrate 10, the flow of the gas introduced into the vacuum container 12 is controlled, so that the organic substance can be supplied uniformly on the entire surface of the substrate (rear plate) 10. As a result, the uniformity of the electron emitting devices is improved. Hence, the diffusing plate 19 preferably is used. As shown in FIGS. 2 and 4, for example, a metal plate having a plurality of apertures 33 is used as the diffusing plate 19. As shown in FIG. 13 or 14, the apertures 33 of the diffusing plate 19 are preferably formed by changing the area or the number from a portion near the inlet 15 to a portion remote from the inlet 15.

In the diffusing plate 19, if the apertures 33 are formed such that the aperture area is larger as the aperture is more separated from the inlet as shown in FIG. 14, or although not shown, that the number of apertures 33 in the plate 19 is larger, or the aperture area is larger and the number of apertures in the plate 19 is larger as the aperture is more separated from the inlet 15, the flow rate of the gas mixture flowing in the vacuum container 12 becomes substantially constant. Hence, such a configuration is more preferable from the viewpoint of improving the uniformity. However, it is important that the diffusing plate 19 have a shape for which the characteristics of the viscous flow are taken into consideration. It should be noted that the shape of the diffusing plate 19 is not limited to the shapes described in this specification.

For example, in one embodiment the apertures 33 may be concentrically formed with an equal interval and with an equal angular interval in the circumferential direction so that the area of each aperture satisfies the relationship represented by formula F1 below. In this case, the apertures 33 are designed so that the area of each aperture increases in proportion to the distance form the inlet of the substrate. It is thereby possible to very uniformly supply the surface of the electron-source substrate 10 with the introduced substance, and uniformly activate the electron emitting devices.

$$Sd=S_0\times\{1+(d/L)/2\}/2 \qquad \text{F1}$$

where d is the distance from an intersection made by an imaginary line from the center of the gas inlet 15 and the diffusing plate 19, L is the distance from the center of the gas inlet 15 to an intersection between an imaginary line extending from the center of the gas inlet 15 and the diffusing plate 19, Sd is the area of an aperture at the distance d from the intersection made by the prolonged line from the center of the gas inlet 15 and the diffusing plate 19, and $S_0$ is the area of an aperture at the intersection between an imaginary line extending from the center of the gas inlet 15 to the diffusing plate 19.

Figure 7:
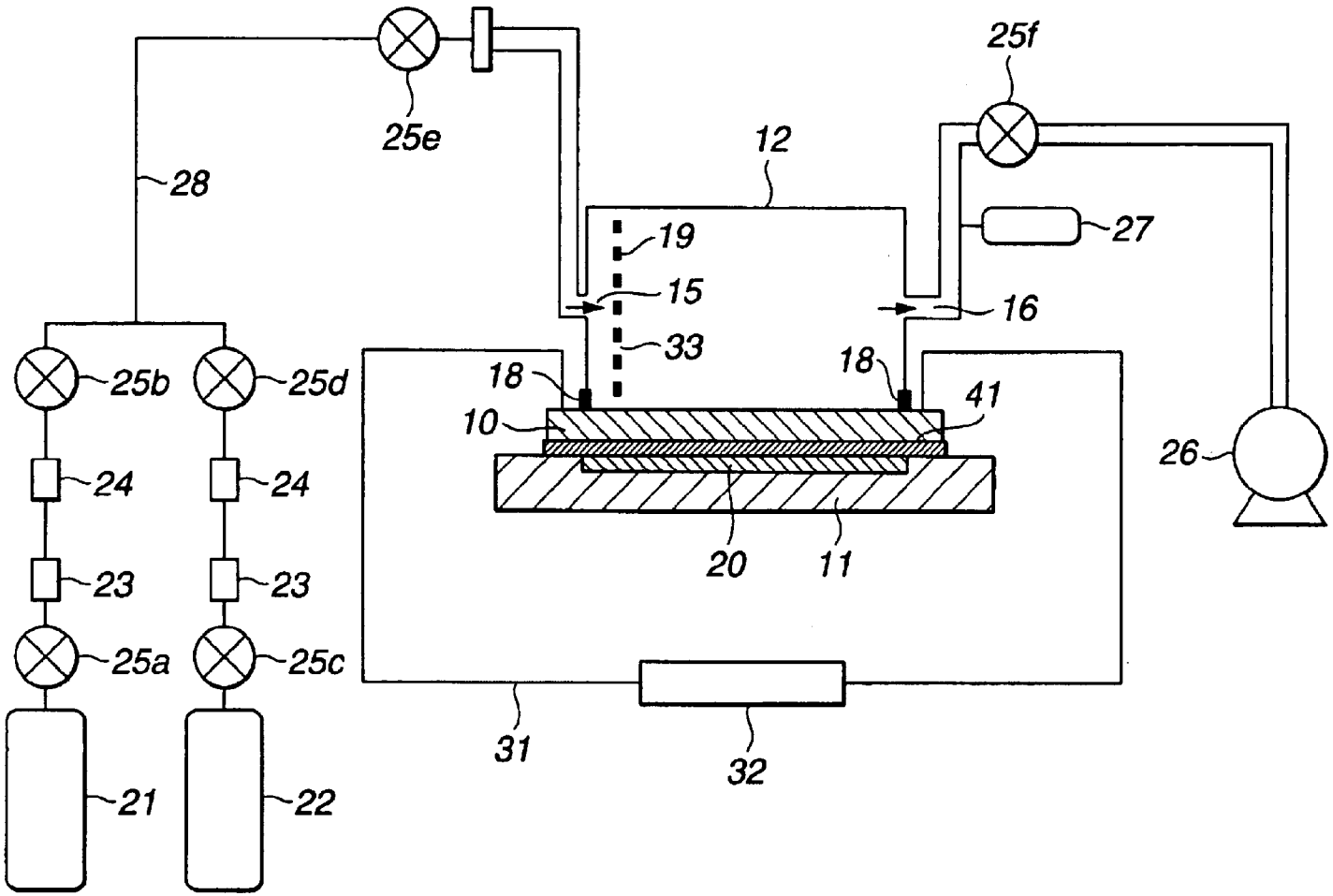
FIG. 7 is a cross-sectional view illustrating the configuration of still another apparatus for manufacturing an electron source which has a sub-vacuum container, according to the present invention.

The positions of the gas inlet 15 and the exhaust outlet 16 are not limited to those referred to above, but those elements 15 and 16 may have various other positions. However, in order to uniformly supply the organic substance into the vacuum container 12, the positions of the gas inlet 15 and the exhaust outlet 16 are preferably at upper positions in the vacuum container 12 as shown in FIG. 2 or 4, or at left and right positions substantially symmetrically as shown in FIG. 7.

As described above, the end portions 30 of the x-direction wires 7 and the y-direction wires 8 are outside the vacuum container 12. The end portions 30 are connected to the driver 32 via a TAB (tape-automated bonding) wire, a probe or the like.

In the case of this manufacturing apparatus, since it is necessary to cover only the respective units 6 with the vacuum container 12 in the above-described manner, it is possible to reduce the size of the manufacturing apparatus. That is, the size of the manufacturing apparatus can be reduced relative to conventional manufacturing apparatuses in which an entire substrate (rear plate) is placed within a vacuum chamber. When performing the "activating" process and the "forming" process after sealing a face plate where an image forming member, such as a phosphor or the like, is disposed and a rear plate on which the units 6 are disposed as in the conventional approach, the conductance is reduced because the separation between the face plate and the rear plate is small, and a long time is required for introducing and exhausting a gas. However, according to the manufacturing method using the manufacturing apparatus of the invention, since the vacuum container 12 having a large volume (a large conductance) covers only a region on the rear plate 10 where the units 6 are disposed, and introduction of a gas into, and exhaust of the gas from, the vacuum container 12 are performed in this state, the amount of time required for the "activating" process and the "forming" process can he greatly reduced relative to that in the conventional technique. Furthermore, since the volume of the vacuum container 12 can be increased, it is possible to very uniformly supply the respective units 6 on the rear plate (the electron-source substrate) 10 with an organic gas or a reducing gas, and, as a result, to form very uniform electron emitting devices. Since the end portions 30 of the x-direction wires 7 and the y-direction wires 8 on the electron-source substrate (rear plate) 10 are outside the vacuum container 12, it is possible to easily perform electrical connection with a power supply device (driver) for applying a voltage to the respective units 6 in the atmospheric air.

By applying a pulse voltage to each of the units 6 on the rear plate through the x-direction wires 7 and the y-direction wires 8 using the driver 32 in a state in which an organic gas is flown into the vacuum container 12 in the above-described manner, the "activating" process for the electron emitting devices can be performed.

Similarly, the above-described "forming" process can be performed by using a reducing gas, such as hydrogen or the like, instead of the organic gas. It is, of course, possible to perform the "forming" process by placing the respective units 6 merely in a vacuum without using the above-described vacuum container 12 (manufacturing apparatus) instead of using the reducing gas.

Figure 5:
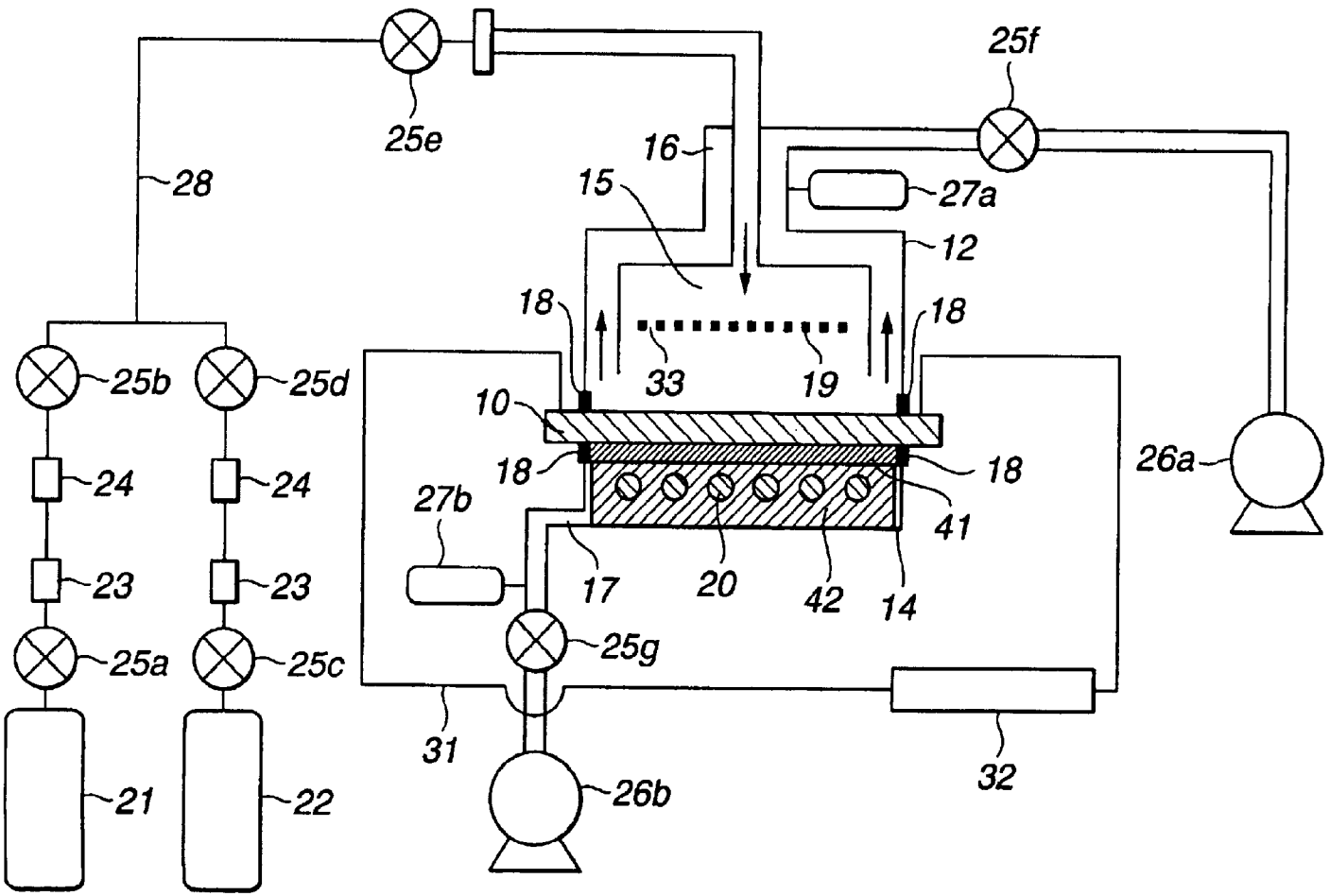
FIG. 5 is a cross-sectional view illustrating the configuration of an apparatus for manufacturing an electron source which has a sub-vacuum container, according to the present invention.
Figure 6:
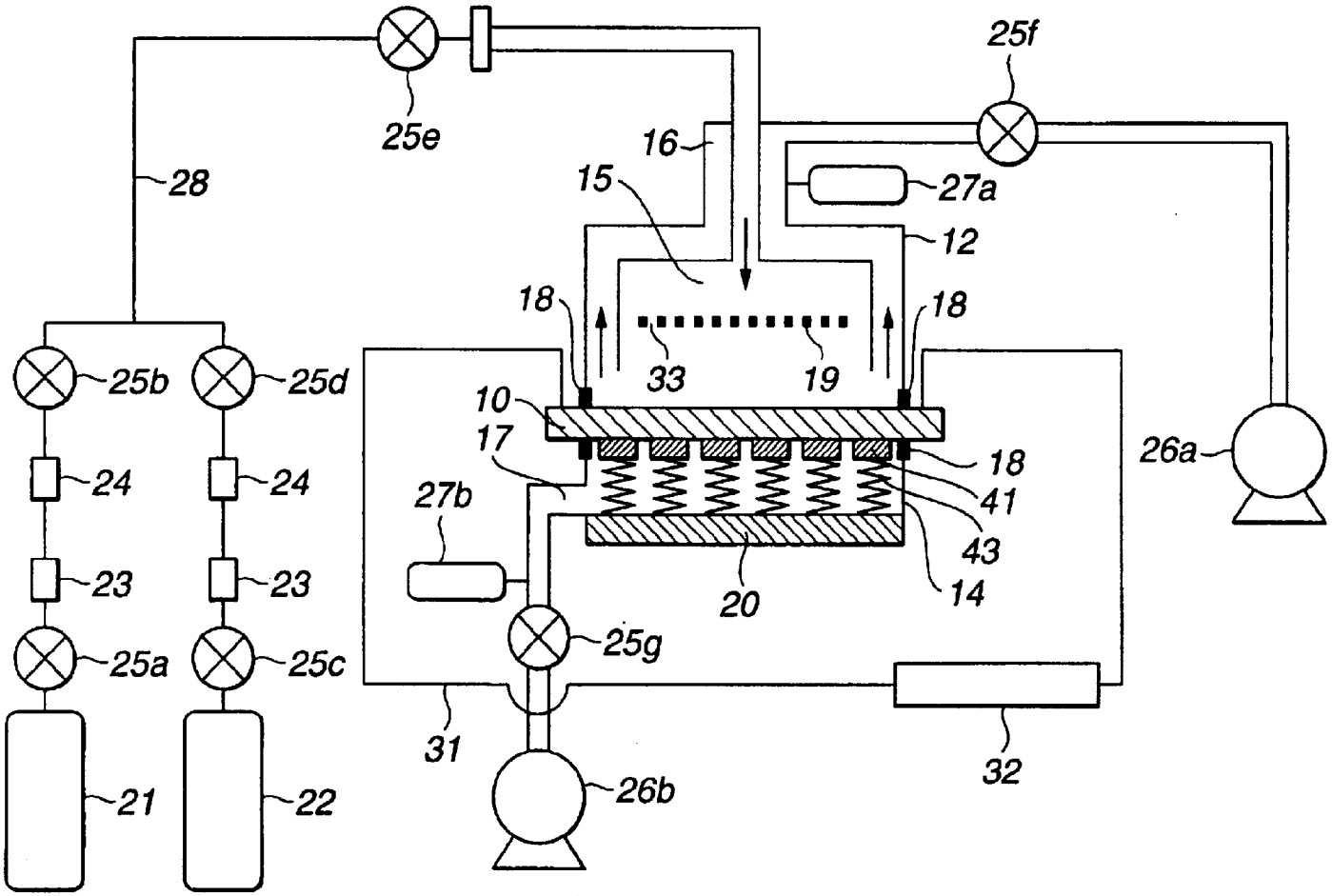
FIG. 6 is a cross-sectional view illustrating the configuration of another apparatus for manufacturing an electron source which has a sub-vacuum container, according to the present invention.

A description will now be provided of other manufacturing apparatuses obtained by changing a part of the above-described manufacturing apparatus. A main change in these apparatuses is the method for supporting the electron-source substrate 10. Other portions are the same as in the above-described apparatus. FIGS. 5 and 6 illustrates such manufacturing apparatuses.

In FIGS. 5 and 6, there are shown a vacuum container 12, a sub-vacuum container 14, and an exhaust outlet 17 for the sub-vacuum container 14. The same components as those shown in FIGS. 2–4 are indicated by the same reference numerals.

When the size of the electron-source substrate 10 is large, in order to prevent damage of the electron-source substrate 10 due to the pressure difference between the surface side and the back side of the electron-source substrate 10, i.e., between the pressure within the vacuum container 12 and the atmospheric pressure, the pressure difference can be mitigated by increasing the thickness of the electron-source substrate 10 to a value so as to be able to endure the pressure difference, or by also using a vacuum chucking method for the electron-source substrate 10.

In these apparatuses, it is intended to cause the pressure difference across the electron-source substrate (rear plate) 10 to disappear or to have a negligibly small value, so that the electron-source substrate 10 can be more thin. When applying this electron-source substrate 10 to an image forming apparatus, the weight of the image forming apparatus can be reduced. In these apparatuses, the electron-source substrate 10 is held between the vacuum container 12 and the sub-vacuum container 14. By maintaining the pressure within the sub-vacuum container 14 replacing the supporting member 11 to a value substantially equal to the pressure within the vacuum container 12, the electron-source substrate 10 is maintained so that it lies in a substantially horizontal plane.

The pressures within the vacuum container 12 and the sub-vacuum container 14 are measured by vacuum gauges 27*a* and 27*b*, respectively. By adjusting the amount of opening of a valve 25*g* of the exhaust outlet of the sub-vacuum container 14, it is possible to make the pressures within the two vacuum containers 12 and 14 substantially the same.

In FIG. 5, a sheet-like first heat conducting member 41 manufactured with the same material as that of the seal member 18, and a metal second heat conducting member 42 having a large heat conductivity in order to more efficiently radiate heat from the electron-source substrate 10 to the outside via the first heat conducting member 41 and the sub-vacuum container 14 are provided within the sub-vacuum container 14 as heat conducting members for the electron-source substrate 10.

In FIG. 6, the first heat conducting member 41, and a third heat conducting member 43 made of a metal elastic material having a large heat conductivity in order to more efficiently radiate heat from the electron-source substrate 10 to the outside via the heat conducting member 41 and the sub-vacuum container 14 are provided.

In FIGS. 5 and 6, in order to facilitate understanding the outline of the apparatuses, the thickness of the sub-vacuum container 14 is shown to be larger than the actual thickness.

A heater (not shown) is embedded within the second heat conducting member 42 so as to be able to heat the electron-source substrate 10, and can be subjected to temperature control from the outside by a control mechanism (not shown).

In still another configuration, a tube-like closed container (not shown) so as to be able to hold or circulate a liquid may be incorporated within the second heat conducting member 42 (FIG. 5). By controlling the temperature of the liquid from the outside, the electron-source substrate 10 can be cooled or heated via the first heat conducting member 41. It also is possible to provide a heater (not shown) at a base portion of the sub-vacuum container 14 or embed a heater (not shown) within a base portion of the sub-vacuum container 14, provide an external control mechanism (not shown) for performing temperature control from the outside, and heat the electron-source substrate 10 via the second heat conducting member 42 and the first heat conducting member 41. Alternatively, it also is possible to provide the above-described heating means (not shown) within the second heat conducting member 42 and at the sub-vacuum container 14, and perform temperature control such as heating, cooling or the like, for the electron-source substrate 10.

Although in the above-described configurations, two different types of heat conducting members 41 and 42 preferably are used, the number of types is not limited to two, but may be one or at least three or more.

The positions of the gas inlet 15 and the exhaust outlet 16 are not limited to those described above, but may be various other positions. However, in order to uniformly supply the organic substance into the vacuum container 12, the positions of the gas inlet 15 and the exhaust outlet 16 are preferably at upper positions in the vacuum container 12 as shown in FIG. 5 or 6, or at left and right positions substantially symmetrically as shown in FIG. 7.

In these configurations, as in the foregoing configuration, when there is a process of introducing a gas into the vacuum container 12, it is preferable to use the diffusing plate 19 in the same manner as described above. As in the foregoing configuration, the forming process can be performed, and the activating process for the electron emitting devices can also be performed by applying a pulse voltage to each of the electron emitting devices 6 on the electron-source substrate 10 via the interconnection 31 by using the driver 32 while flowing the gas mixture containing the organic substance into the container 12.

Figure 8:
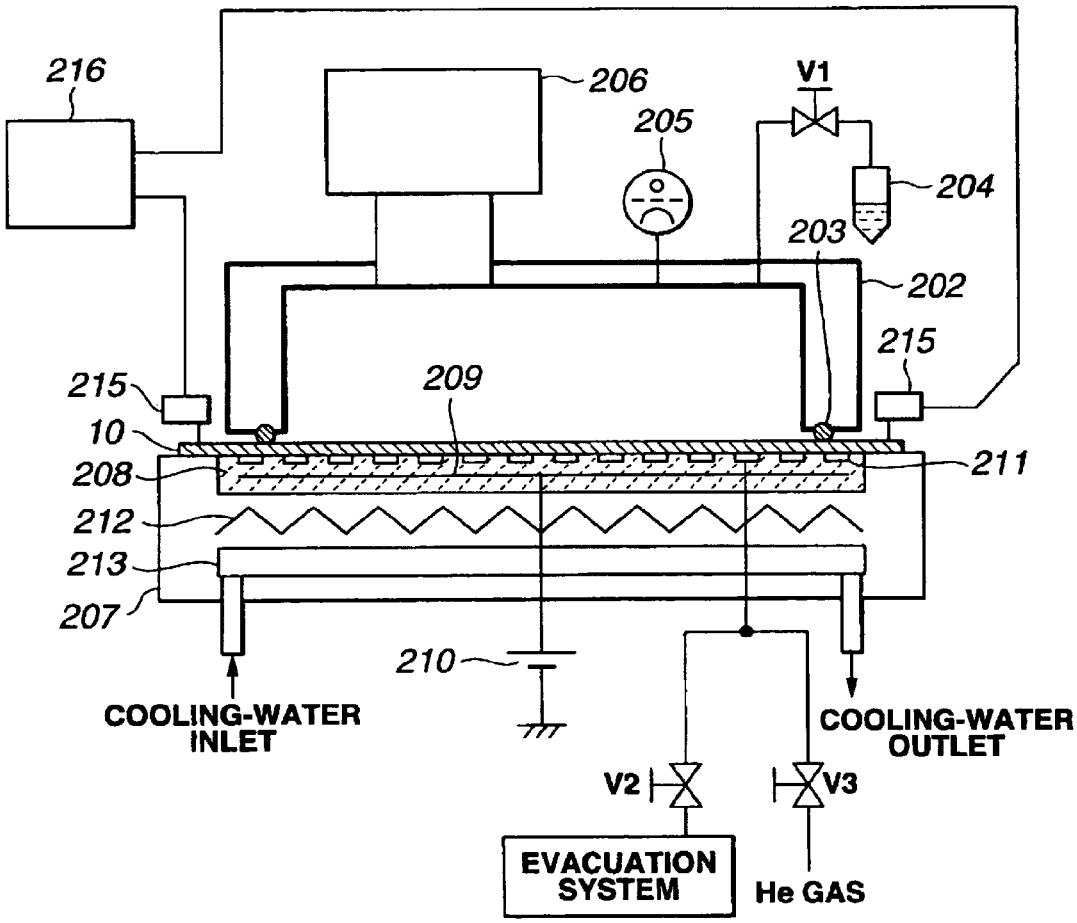
FIG. 8 is a cross-sectional view illustrating the configuration of yet another manufacturing apparatus according to the present invention.

A manufacturing apparatus having a still another configuration will now be described with reference to FIG. 8. In this configuration, in order to prevent deformation or damage of a substrate 10 due to the above-described pressure difference between the surface and the back of the substrate 10, an electrostatic chuck 208 is provided at a substrate holder 207. Fixing of the substrate 10 by the electrostatic chuck is realized by attracting the substrate 10 to substrate holder 207 by an electrostatic force produced by applying a voltage between an electrode 209 and the substrate 10 placed in the electrostatic chuck 208. There are also shown an O-ring 203, benzonitrile 204, a vacuum gauge 205, an evacuation system 206, a probe unit 215, and a pulse generator 216.

In order to maintain a predetermined potential on the substrate 10, a conductive film (not shown), such as an ITO (indium tin oxide) film or the like, is formed on the back of the substrate 10. For attracting the substrate 10 according to the electrostatic chuck method, the distance between the electrode 209 and the substrate 10 must be short. Hence, it is desirable to first press the substrate 10 against the electrostatic chuck 208 according to another method In the apparatus shown in FIG. 8, the substrate 10 is pressed against the electrostatic chuck by the atmospheric pressure by evacuating the inside of grooves 211 formed on the surface of the electrostatic chuck 208, and the substrate 10 is sufficiently attracted by applying a high voltage to the electrode 209 from a voltage power supply 210.

Even if the inside of a vacuum chamber 202 is thereafter evacuated, the pressure difference applied to the substrate 10 is cancelled due to an electrostatic force by the electrostatic chuck 208, so that it is possible to prevent deformation or damage of the substrate 10.

In order to improve heat conduction between the electrostatic chuck 208 and the substrate 10, it is desirable to introduce a gas for heat exchange into the grooves 211 after first evacuating them as described above. Although He is desirable as the gas, any other gas is also effective. By introducing the gas for heat exchange, heat conduction between the substrate 10 and the electrostatic chuck 208 at a portion where the grooves 211 are present is realized. Even at a portion where the grooves 211 are absent, since heat conduction is improved relative to a case in which there is thermal contact between the substrate 10 and the electrostatic chuck 208 merely by mechanical contact, heat conduction as a whole is substantially improved. According to the above-described configuration, heat generated at the substrate 10 easily moves to the substrate holder 207 via the electrostatic chuck 208 during the forming process, the activating process or the like, so that generation of an undesired temperature distribution due to an undesired temperature rise of the substrate 10 or local heat generation is suppressed. Furthermore, by providing temperature control means, such as a heater 212, a cooling unit 213 and the like, at the substrate holder 207, the temperature of the substrate 10 can be very precisely controlled.

EXAMPLE 1

Figure 15:
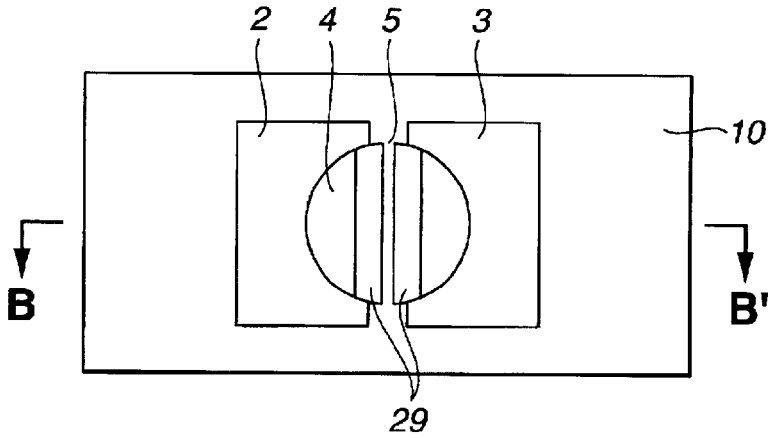
FIG. 15 is a plan view illustrating the configuration of an electron emitting device according to the present invention.
Figure 16:
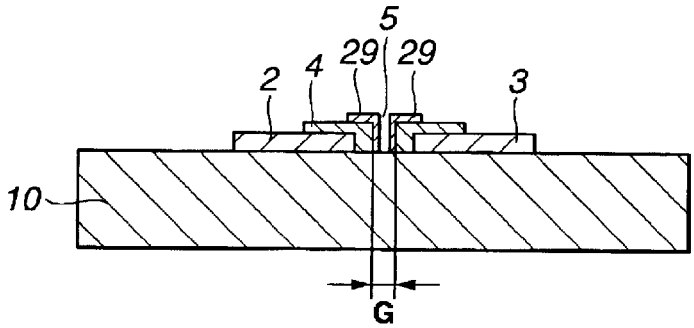
FIG. 16 is a cross-sectional view of the electron emitting device taken along line B–B' shown in FIG. 15.
Figure 17:
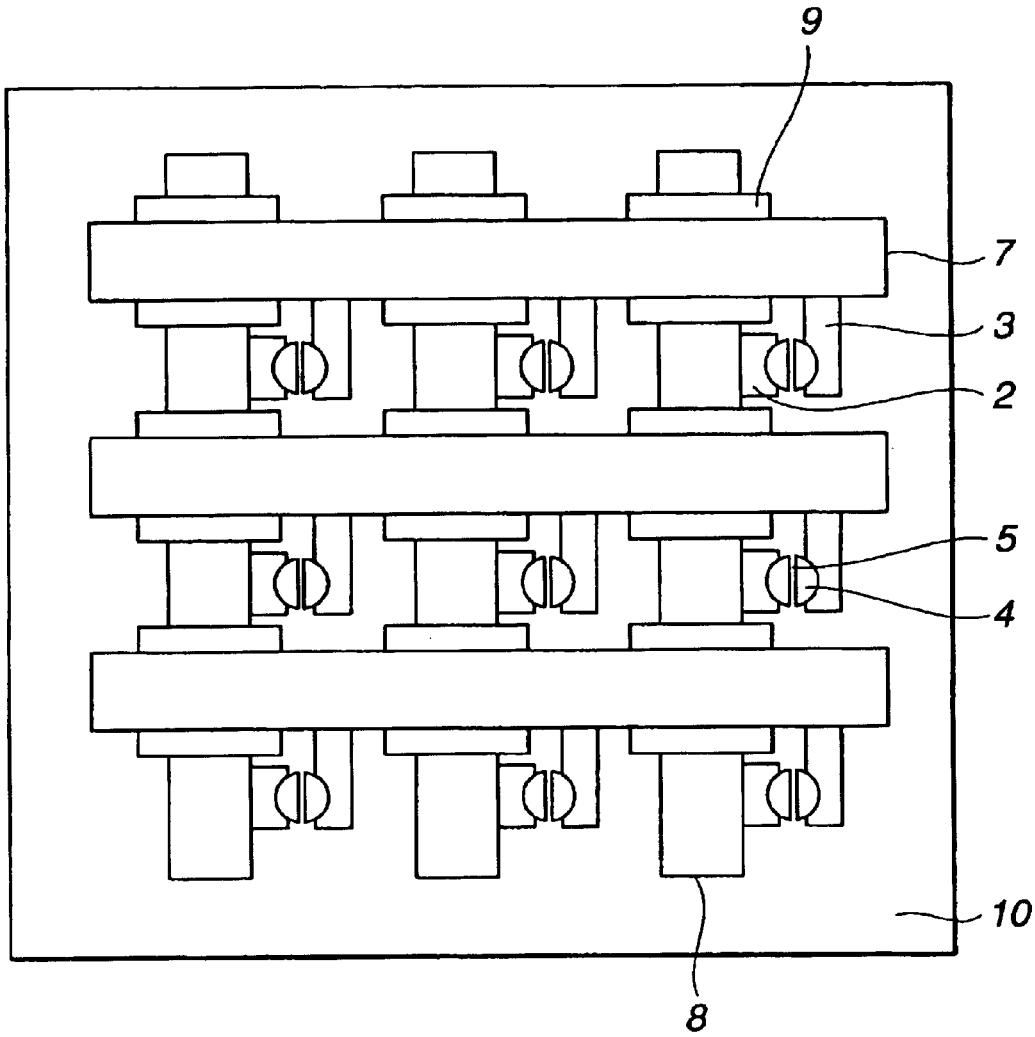
FIG. 17 is a plan view illustrating an electron source according to the present invention.

A process for manufacturing an electron-source substrate shown in FIG. 17 including a plurality of surface-conduction-type electron emitting devices shown in FIGS. 15 and 16, using the above-described manufacturing apparatus of the present invention will now be more specifically described.

In FIGS. 15–17, there are shown a substrate (rear plate) 10, electrodes 2 and 3, a conductive film 4, a carbon film 29, a gap 5 in the carbon film 29, and a gap G in the conductive film 4.

First, a Pt paste was subjected to printing on a glass substrate (having a size of 350×300 mm, and a thickness of 5 mm) having a $SiO_2$ layer formed thereon, according to offset printing. The printed film was baked to form the electrodes 2 and 3 having a thickness of 50 nm as shown in FIG. 16. Then, an Ag paste was subjected to printing according to screen printing. The printed film was baked to form x-direction wires 7 (240 in total) and y-direction wires (20 in total) 8 shown in FIG. 17. An insulating paste was subjected to printing according to screen printing on intersections made by the x-direction wires 7 and the y-direction wires 8. The printed film was baked to form an insulating layer 9.

Then, a palladium-complex solution was provided onto each portion between the electrodes 2 and 3 according to an inkjet method. Although a bubble-jet-type apparatus was used as an inkjet apparatus, a so-called piezoelectric ink-jet apparatus may also be used. The conductive film 4 made of palladium oxide was formed by baking droplets provided on the substrate 10 at 350° C. for 30 minutes. The thickness of the conductive film 4 was 20 nm. Thus, a plurality of units 6, each including the pair of electrodes 2 and 3 and the conductive film 4, were formed on the substrate (rear plate) 10. The units 6 were connected in the form of a matrix by the x-direction wires 7 and the y-direction wires 8. Thus, the electron-source substrate 10 before the "forming" process was formed.

The electron-source substrate 10 manufactured in the above-described process was fixed on the supporting member 11 of the manufacturing apparatus shown in FIGS. 2 and 3. A heat conductive rubber sheet 41 having a thickness of 1.5 mm was grasped between the supporting member 11 and the electron-source substrate 10.

Then, the stainless-steel vacuum container 12 was disposed on the electron-source substrate 10 as shown in FIG. 3 via the seal member 18 made of silicone rubber, such that the end portions 30 of the x-direction wires 7 and the y-direction wires 8 were outside of the vacuum container 12 (and exposed to the atmospheric air). A metal plate in which the apertures 33 as shown in FIG. 13 or 14 are formed, was provided above the electron-source substrate 10 as the diffusing plate 19.

After opening the valve **25*f* (FIG. 2) for the exhaust outlet 16, and evacuating the inside of the vacuum container 12 to about $33\times10^{-1}$ Pa ($1\times10^{-3}$ Torr) by the vacuum pump 26 (a scroll pump in this case), in order to remove water estimated to adhere to the tube of the evacuation apparatus and the electron-source substrate 10, a baking process of raising the temperature of the substrate 10 to 120° C. using a heater (not shown) for the tube and the heater 20 for the electron-source substrate 10**, and cooling the temperature to the surrounding room temperature after maintaining the above-described temperature was performed.

After the temperature of the substrate 10 returned to the room temperature, the gap G shown in FIG. 16 was formed in the conductive film 4 by passing a current in the conductive film 4 by applying a voltage between the electrodes 2 and 3 of each of the units 6 via the x-direction wires 7 and the y-direction wires 8 using the driver 32 connected to the end portions 30 via the wires 31 shown in FIG. 3 (the "forming" process).

Then, the "activating" process was performed using the same apparatus. The gas mixture of the organic gas 21 and the carrier gas 22 was introduced into the vacuum container 12 by opening the valves **25*a*–25*d* for supplying the gases and opening the valve 25*e* for the air inlet 15 shown in FIG. 2. An ethylene gas was used as the organic gas 21, and a nitrogen gas was used as the carrier gas 22. The pressure within the vacuum container 12 was set to a desired pressure by adjusting the amount of opening of the valve 26*f* while watching the pressure of the vacuum gauge 27 at the exhaust outlet 16**.

After introducing the organic gas, the "activating" process was performed by applying a pulse voltage between the electrodes 2 and 3 of each of the units 6 via the x-direction wires 7 and the y-direction wires 8 using the driver 32. In the "activating" process, the entirety of the y-direction wires 8 and unselected lines of the x-direction wires 8 were commonly connected to Gnd (ground potential), and a pulse voltage was sequentially applied to each line by selecting a desired one of the x-direction wires 7.

A device current If (a current flowing between the electrodes of an electron emitting device) when completing the activating processing was measured for each of the x-direction wires 7. A result of comparison of measured values of the device current If indicated that variations among the x-direction wires 7 were small, and therefore a successful and advantageous activating process could been performed.

As shown in FIGS. 15 and 16, carbon films 29 were formed across the gap 5 in the electron emitting device after completing the activating process.

EXAMPLE 2

Next, an example of manufacturing an electron-source substrate using the manufacturing apparatus shown in FIG. 5 will be described.

Figure 18:
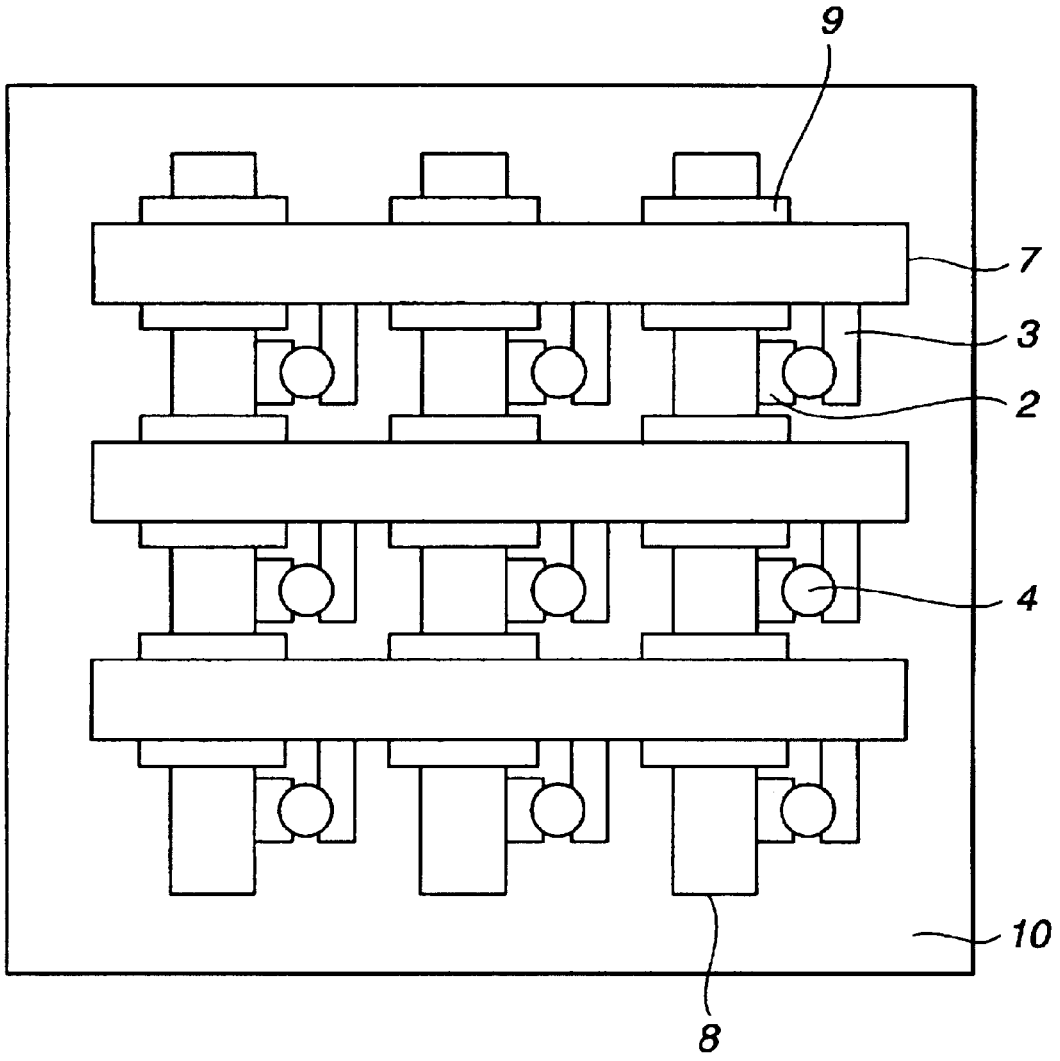
FIG. 18 is a plan view illustrating a method for manufacturing an electron source according to the present invention.

An electron-source substrate before the "forming" process was manufactured in the same manner as in Example 1 by using a glass substrate comprised of $SiO_2$ 3 and being mm thick, as the rear plate 10 (see FIG. 18). This electron-source substrate 10 was placed between the vacuum container 12 and the sub-vacuum container 14 of the manufacturing apparatus shown in FIG. 5 via the seal member 18 made of silicone rubber with a sheet-like heat conducting member 41 made of silicone rubber having column-shaped projections on a surface contacting the electron-source substrate 10, and a heat conduction member 42 made of aluminum having an embedded heater (not shown) therewithin, in the manner shown in FIG. 5.

In Example 2, however, in contrast to the case shown in FIG. 5, the "activating" process was performed without providing the diffusing plate 19.

The inside of the vacuum container 12 and the inside of the sub-vacuum container 14 were evacuated by vacuum pumps (scroll pumps in this case) 26*a* and 26*b*, respectively, by opening a valve 25*f* for the exhaust outlet 16 of the vacuum container 12 and the valve 25*g* for the exhaust outlet 17 of the sub-vacuum container 14.

Evacuation was performed while maintaining the pressure within the vacuum container 12 so that it was greater than or equal to the pressure within the sub-vacuum container 14. According to this condition, when the substrate 10 is deformed to produce a strain due to the pressure difference, the substrate 10 becomes convex relative to the sub-vacuum container 14 to be pressed against the heat conducting member 41, which suppresses the deformation and supports the substrate 10.

If the size of the electron-source substrate 10 is large and the thickness of the electron-source substrate 10 is small, and if a condition opposite to that described above is present, i.e., the pressure within the vacuum container 12≦ the pressure within the sub-vacuum container 14, then when the electron-source substrate 10 becomes convex relative to the vacuum container 12, the electron-source substrate 10 may become damaged (in the worst case) because there is no member for suppressing the deformation of the substrate 10 in that direction, resulting from the pressure difference, and for supporting the electron-source substrate 10 within the vacuum container 12. That is, in the electron-source manufacturing apparatus shown in FIG. 5, as the size of the electron-source substrate 10 is larger and the thickness of the electron-source substrate 10 is smaller, the heat conducting member 41 also operating as the substrate holding member becomes more important.

Then, as in Example 1, the gap G shown in FIG. 16 was formed in the conductive film 4 by passing a current by applying a voltage between the electrodes 2 and 3 of each of the units 6 via the x-direction wires 7 and the y-direction wires 8 using the driver 32 (the "forming" process). In this manufacturing method, a hydrogen gas for reducing palladium oxide was gradually introduced simultaneously with a start of voltage application, in order to accelerate formation of the gap G in the conductive film 4.

Then, the "activating" process was performed using the same apparatus. The gas mixture of the organic gas 21 and the carrier gas 22 was introduced into the vacuum container 12 by opening the valves 25*a*–25*d* for supplying the gases and the valve 25*e* for the gas inlet 15. A propylene gas was used as the organic gas 21, and a nitrogen gas was used as the carrier gas 22. The gas mixture was introduced into the vacuum container 12 after being passed through the respective water removing filters 23. The pressure within the vacuum container 12 was set to a desired pressure by adjusting the amount of opening of the valve 25*f* while watching the pressure of the vacuum gauge 27 for the exhaust outlet 16.

At the same time, the pressure within the sub-vacuum container 14 was set to be lower than the pressure within the vacuum container 12 by adjusting the amount of opening of the valve 25*g* for the exhaust outlet 17 of the sub-vacuum container 14.

Then, as in Example 1, the "activating" process was performed by applying a voltage between the electrodes 2 and 3 of each of the units 6 via the x-direction wires 7 and the y-direction wires 8 using the driver 32. A device current (a current flowing between the electrodes 2 and 3) If present during the activating processing was measured in the same manner as in Example 1. The result of the measurement indicated that variations in the current in the devices were small, and therefore an excellent and improved activating process could been performed.

As shown in FIGS. 15 and 16, carbon films 29 were formed across the gap 5 in the electron emitting device after completing the activating process.

In this manufacturing process, since the gas mixture containing the organic substance was introduced into the vacuum container 12 at a viscous-flow region having a pressure of $266\times10^2$ Pa (200 Torr), the organic substance within the vacuum container 12 could be made constant in a short time. As a result, the time required for the activating process could be largely shortened

EXAMPLE 3

In Example 3, the electron-source substrate 10 manufactured by the manufacturing apparatus and the manufacturing process described in Example 1 and Example 2 was used for the image display device shown in FIGS. 1A and 1B.

FIG. 1A is a schematic diagram illustrating the image display device manufactured in Example 3, and FIG. 1B is a cross-sectional view of the device taken along the x-z plane.

In FIG. 1A, there are shown the electron emitting devices 69, and the supporting frame 62. The faceplate 66 includes the glass substrate 63, the metal back 64 and the phosphor 65. There is also shown the high-voltage terminal 67. Reference numeral 61 represents a trace of connection of the seal member 18 remaining after the vacuum container 12 (not shown in FIGS. 1A and 1B) was mounted on the electron-source substrate 10 and then removed together with the seal member 18 in the electron-source-substrate manufacturing process.

As shown in FIG. 1B, connection members 70 made of frit glass, an indium alloy or the like are grasped between the electron-source substrate 10 and the supporting frame 62, and between the faceplate 66 and the supporting frame 62.

The connection position 71 between the electron-source substrate 10 and the supporting frame 62 was arranged to be outside the contact region 61 of the seal member 18 so as not to overlap therewith. In the connection region 61, a part of an O-ring or a rubber sheet made of nitrile rubber, silicone rubber, fluororubber or the like, serving as the seal member 18, sometimes remains as a residue as a result of being pressed against the electron-source substrate 10 or heat treatment of the electron-source substrate 10. As a result, the surface state of the electron-source substrate 10 sometimes greatly changes, represented by, for example, a decrease in the wettability at the contact region 61. Accordingly, when intending to perform connection between the supporting frame 62 and the electron-source substrate 10 at the contact region 61, an insufficient connection sometimes occurs as a result of the residue, thereby sometimes causing vacuum leakage when evacuating the inside of the image display device, as will be described below. Hence, in the present invention, connection between the supporting frame 62 and the electron-source substrate 10 is performed at a region (the contact position 71) different from the contact region 61.

The arrangement of the contact position 71 outside the contact region 61 of the seal member 18 contributes to reduction in the size of the vacuum container 12.

The inside of the image display device is maintained in a low-pressure state. The image display device as shown in FIGS. 1A and 1B is manufactured by evacuating the inside of the image display device, for example, via an exhaust tube (not shown) provided at the faceplate 66 to maintain the inner pressure to a value less than the atmospheric pressure, and then sealing the exhaust tube. In order to maintain the pressure within the image display device after sealing, a getter material (not shown) is sometimes provided within the image display device and is subjected to high-frequency heating.

In the image display device manufactured in the above-described manner, the vacuum state within the image display device can be maintained in a desired condition. An image is displayed by emitting an electron from each electron emitting device by applying a scanning signal and a modulating signal from a signal generation means (not shown) via the terminals Dx1–Dxm, and Dy1–Dyn, and accelerating an emitted electron beam by applying a high voltage of 5 kV to the metal back 65 or a transparent electrode (not shown) via the high-voltage terminal 67 to cause the electron beam to impinge upon the phosphor film 64, thereby exciting the phosphor to emit light.

In the image display apparatus manufactured in the above-described manner, an excellent image is provided in which variations in the luminance and irregularity in color are minimized, thereby rendering the apparatus highly suitable for use as a television.

EXAMPLE 4

Example 4 will now be described with reference to FIGS. 19A and 19B. FIG. 19A is a schematic perspective view illustrating an image display device manufactured in Example 4. FIG. 19B is a schematic cross-sectional view taken along the x-z plane of FIG. 19A. In FIGS. 19A and 19B, the same components as those shown in FIGS. 1A and 1B are indicated by the same reference numerals.

In Example 4, the contact position 71 between the electron-source substrate 10 and the supporting frame 62 manufactured in Example 1 or Example 2 is arranged so as to be within the contact region 61 of the seal member 18 (so as not overlap therewith). The image display device was otherwise manufactured in the same manner as in Example 3. In Example 4, since the size of the faceplate 66 can be reduced and the trace of region 61 on the electron-source substrate 10 is outside a portion where a vacuum is formed, the influence of gases emitted from the trace of region 61 on the electron source need not be considered.

As in the image display device manufactured in Example 3, an image which is excellent and stable for a long time could be obtained in the image display device manufactured in Example 4.

According to the present invention, it is possible to provide a method for manufacturing an image display device which is adapted for being mass produced with an increased manufacturing speed relative to those of the prior art.

According to the present invention, it is possible to provide a method for manufacturing an image display device in which an electron source having excellent electron emission characteristics can be manufactured.

According to the present invention, it is possible to provide an image display device having an excellent image quality by forming stable vacuum tightness.

The individual components shown in outline in the drawings are all well known in the image-display-device manufacturing method arts and their specific construction and operation are not critical to the operation or the best mode for carrying out the invention, and thus will not be described in further detail herein.

While the present invention has been described with respect to what are presently considered to be the preferred embodiments, it is to be understood that the invention is not limited only to the disclosed embodiments. To the contrary, the present invention is intended to cover various modifications and equivalent arrangements included within the spirit and scope of the appended claims. The scope of the following claims is to be accorded the broadest reasonable interpretation so as to encompass all such modifications and equivalent structures and functions.

What is claimed is:

1. A method for manufacturing an image display device, said method comprising the steps of:

preparing a first substrate having a first surface and a second surface facing each other, wherein conductors and wires connecting the conductors are formed on the first surface;

disposing the first substrate, on a supporting member so as to fix the second surface to the supporting member;

covering a part of the first surface with a container, for disposing the conductors into a space formed by the first surface and the container, wherein a part of each wire is disposed outside of the space;

providing the space formed between the container and the first surface with a desired atmosphere;

applying a voltage to the conductors through the part of the wires disposed outside of the space;

removing the container from the first surface; and connecting a second substrate, including an image forming member, via a connecting member, to a region of the first surface different from a region of the first surface where the container and the first surface are connected together.

2. A method according to claim 1, wherein said step of providing the space with the desired atmosphere includes evacuating the space.

3. A method according to claim 1, wherein said step of providing the space with the desired atmosphere includes introducing a gas into the space.

4. A method according to claim 1, wherein the second surface is fixed to the supporting member by performing a vacuum attraction of the second surface to the supporting member.

5. A method according to claim 1, wherein the second surface is fixed to the supporting member by performing electrostatic attraction of the second surface to the supporting member.

6. A method according to claim 1, wherein said step of disposing the first substrate on the supporting member is performed by disposing a heat conduction member between the first substrate and the supporting member.

7. A method according to claim 1, wherein said step of applying the voltage to the conductors includes the step of adjusting a temperature of the first substrate.

8. A method according to claim 1, wherein said step of applying the voltage to the conductors includes the step of heating the first substrate.

9. A method according to claim 1, wherein said step of applying the voltage to the conductors includes the step of cooling the first substrate.

10. A method for manufacturing an image display device, said method comprising the steps of:

preparing a first substrate having a first surface and a second surface facing each other, wherein a plurality of units including a pair of electrodes connected via a conductive film and wires connecting the plurality of units are formed on the first surface;

disposing the first substrate on a supporting member, so as to fix the second surface to the supporting member;

covering a part of the first surface with a container, for disposing the plurality of units into a space formed by the first surface and the container, wherein a part of each wire is disposed outside of the space;

providing the space formed between the container and the first surface with a desired atmosphere;

converting each of the plurality of units into an electron-emitting device by applying a voltage to the plurality of units through the part of the wires disposing outside of the space;

removing the container from the first surface; and connecting a second substrate, including an image forming member, to the first substrate, via a connecting member, at a region of the first surface different from a region of the first surface where the container and the first surface are connected together.

11. A method for manufacturing an image display device, said method comprising the steps of preparing a first substrate having a first surface and a second surface facing each other, wherein a plurality of units including a pair of electrodes connected via a conductive film, a plurality of x-direction wires connecting the units, and a plurality of y-direction wires connecting the units are formed on the first surface;

disposing the first substrate on a supporting member, so as to fix the second surface to the supporting member;

covering a part of the first surface with a container, for disposing the plurality of units into a space formed by the first surface and the container, wherein a part of each x-direction wire and a part of each y-direction wire are disposed outside of the space;

providing the space formed between the container and the first surface with a desired atmosphere;

converting each of the plurality of units into an electron-emitting device by applying a voltage to the plurality of units through the part of the plurality of x-direction wires and the plurality of y-direction wires disposed outside of the space;

removing the container from the first surface; and connecting a second substrate including an image forming member to the first substrate via a connecting member, at a region of the first surface different from a region of the first surface where the container and first surface are connected together.

12. A method according to claim 10 or 11, wherein said step of providing the space with the desired atmosphere includes evacuating the space.

13. A method according to claim 10 or 11, wherein said step of providing the space with the desired atmosphere includes introducing a gas into the space.

14. A method according to claim 10 or 11, wherein the second surface is fixed to the supporting member by performing a vacuum attraction of the second surface to the supporting member.

15. A method according to claim 10 or 11, wherein the second surface is fixed to the supporting member by performing electrostatic attraction of the second surface to the supporting member.

16. A method according to claim 10 or 11, wherein said step of disposing the first substrate on the supporting member is performed by disposing a heat conduction member between the first substrate and the supporting member.

17. A method according to claim 10 or 11, wherein the applying of the voltage includes the step of adjusting a temperature of the first substrate.

18. A method according to claim 10 or 11, wherein the applying of the voltage includes the step of heating the first substrate.

19. A method according to claim 10 or 11, wherein the applying of the voltage includes the step of cooling the first substrate.

* * * * *

UNITED STATES PATENT AND TRADEMARK OFFICE

CERTIFICATE OF CORRECTION

PATENT NO. : 6,780,074 B2
DATED : August 24, 2004
INVENTOR(S) : Toshimichi Ouchi It is certified that error appears in the above-identified patent and that said Letters Patent is hereby corrected as shown below:

Title page,
Item [30], Foreign Application Priority Data, "2000/061127" should read -- 2000-061127 --; and "2001/048989" should read -- 2001-048989 --.

Column 1,
Line 9, "Art" should read -- Art ¶ --.

Column 7,
Line 17, "wires:" should read -- wires --; and
Line 25, "airtight" should read -- air-tight --.

Column 8,
Line 60, "easily deformable" should read -- easily-deformable --.

Column 14,
Line 44, "method" should read -- method. --.

Column 16,
Line 26, "valve 26f" should read -- valve 25f --.

Column 21,
Line 24, "of" should read -- of: --.

Signed and Sealed this

Thirtieth Day of August, 2005

JON W. DUDAS
*Director of the United States Patent and Trademark Office*